US008863615B2

(12) United States Patent
Yabuuchi et al.

(10) Patent No.: US 8,863,615 B2
(45) Date of Patent: Oct. 21, 2014

(54) ROLLER LIFTER, ROLLER LIFTER PRODUCTION METHOD AND LIQUID PUMP

(75) Inventors: Takeyuki Yabuuchi, Toyota (JP); Takashi Usui, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 889 days.

(21) Appl. No.: 13/001,629

(22) PCT Filed: Sep. 2, 2009

(86) PCT No.: PCT/IB2009/006704

§ 371 (c)(1),
(2), (4) Date: Dec. 28, 2010

(87) PCT Pub. No.: WO2010/026463

PCT Pub. Date: Mar. 11, 2010

(65) Prior Publication Data

US 2011/0158835 A1 Jun. 30, 2011

(30) Foreign Application Priority Data

Sep. 4, 2008 (JP) ..... 2008-227648

(51) Int. Cl.
*F16H 53/06* (2006.01)
*F04B 1/04* (2006.01)
*F01L 1/14* (2006.01)

(52) U.S. Cl.
CPC ..... *F01L 1/143* (2013.01); *F04B 1/0426* (2013.01)
USPC ..... 74/569; 92/129

(58) Field of Classification Search
CPC ..... F16J 1/20; F16H 53/06
USPC ..... 92/72, 129; 74/569
See application file for complete search history.

(56) References Cited

U.S. PATENT DOCUMENTS

| | | | | |
|---|---|---|---|---|
| 3,431,896 | A * | 3/1969 | Giulietti | 74/569 |
| 3,795,229 | A | 3/1974 | Weber | |
| 4,335,685 | A * | 6/1982 | Clouse | 123/90.5 |
| 5,553,512 | A * | 9/1996 | Harimoto | 74/569 |
| 5,676,098 | A | 10/1997 | Cecur | |

FOREIGN PATENT DOCUMENTS

| | | |
|---|---|---|
| DE | 21 45 823 | 3/1973 |
| DE | 38 06 839 | 9/1989 |

(Continued)

OTHER PUBLICATIONS

International Search Report issued Dec. 15, 2009 in PCT/IB09/06704 filed Sep. 2, 2009.

*Primary Examiner* — F. Daniel Lopez
(74) *Attorney, Agent, or Firm* — Oblon, Spivak, McClelland, Maier & Neustadt, L.L.P.

(57) ABSTRACT

A roller lifter including a roller that is rotatably supported and a body that supports the roller, the body including: a base portion in the form of a flat plate; a roller holding portion in the form of a pair of opposing plate-shaped portions that are formed by bending towards one of plate surfaces of the base portion, the roller holding portion being configured to hold the roller between the plate-shaped portions; and a guide portion in the form of a plate-shaped portion formed by bending towards the other one of the plate surfaces of the base portion and also formed by curving so that the plate-shaped portion follows a cylindrical surface shape in which a direction perpendicular to the plate surface of the base portion is the axial direction of the cylinder, the guide portion being configured to form a guide surface in a shape that follows the cylindrical surface shape.

14 Claims, 29 Drawing Sheets

(56) References Cited

FOREIGN PATENT DOCUMENTS

| | | |
|---|---|---|
| EP | 0 770 762 | 5/1997 |
| JP | 49 89012 | 8/1974 |
| JP | 9 125915 | 5/1997 |
| JP | 2001 221131 | 8/2001 |
| JP | 2002 332809 | 11/2002 |
| JP | 2003 269295 | 9/2003 |
| WO | 02 20953 | 3/2002 |
| WO | 2008 068116 | 6/2008 |

* cited by examiner

<PRIOR ART>

ROLLER LIFTER, ROLLER LIFTER PRODUCTION METHOD AND LIQUID PUMP

INCORPORATION BY REFERENCE

The disclosure of Japanese Patent Application No. 2008-227648 filed on Sep. 4,2008, including the specification, drawings and abstract is incorporated herein by reference in its entirety.

BACKGROUND OF THE INVENTION

1. Field of the Invention

The invention relates to a roller lifter that contacts through a roller a cam reciprocating a member for pumping a liquid in a liquid pump such as a high-pressure fuel pump configuring a fuel supply system of an automobile engine, a method of producing the roller lifter and a liquid pump.

2. Description of the Related Art

Roller lifters (roller tappets) that contact a member for pumping a liquid with a reciprocating cam through a roller have conventionally been used as lifters (also referred to as tappets) provided in liquid pumps such as high-pressure fuel pumps composing fuel supply systems of automobile engines, for example. More specifically, this type of liquid pump as described above is provided with a member for pumping a liquid in the form of a plunger and a cam that causes the plunger to reciprocate by rotating. The plunger is urged in the direction of reciprocation that faces the cam by an elastic member such as a coil spring. Namely, liquid pumps provided with a roller lifter are composed in the form of plunger drive pumps that pump a liquid by causing a plunger, which is urged toward a cam that rotates centering about a prescribed axis of rotation, to reciprocate by rotation of the cam. In this configuration, the roller lifter is interposed between the plunger and the cam.

In addition to supporting one end of the plunger, the roller lifter contacts the cam while urged toward the cam by an elastic member for urging the plunger. In other words, the plunger is urged in the direction facing the cam mediated by the roller lifter together with receiving rotation of the cam. Thus, the roller lifter reciprocates together with the plunger accompanying rotation of the cam. The roller lifter is mediated by a rotating body in the form of a roller during contact with the cam.

The roller in the roller lifter is in a state in which the mutual outer peripheral surface thereof contacts the cam while being supported so that the direction of the axis of rotation is the same as that of (parallel to) the cam. While in this state, the roller moves in the direction of reciprocating motion of the plunger mediated by the roller lifter, namely in the direction opposing the urging force applied by an elastic member of the plunger, and in the opposite direction thereof (direction in which urged by the elastic member). Here, the roller in contact with the cam rotates by frictional force and so forth in response to rotation of the cam.

This type of roller lifter has a portion that holds the roller that contacts the cam, and a portion that forms guide surfaces that guide reciprocating motion of the roller lifter by contacting a prescribed sliding surface formed by a member, for example, that houses the plunger. According to this type of roller lifter, frictional force accompanying cam rotation at contacting portions of the roller lifter and the cam is absorbed by rotation of the roller, thereby reducing wear of the contacting portions.

An example of a technology relating to a roller lifter is disclosed in Japanese Patent Application Publication No. 9-125915 (JP-A-9-125915). JP-A-9-125915 discloses a configuration containing a hollow body made of a pressed sheet metal material, and a block housed in the body having a cylindrical bearing surface that houses a roller. In this configuration, the body configures a portion that forms guide surfaces, and the block configures a portion that holds the roller.

In JP-A-9-125915, the portion that forms the guide surfaces and the portion that holds the roller in the roller lifter are composed by different members. In other words, the roller lifter of JP-A-9-125915 has a structure in which a plurality of members containing the body and the block are assembled. Consequently, the number of constituent parts and the number of production steps increase, thereby resulting in increased costs.

In addition, some typical conventional roller lifters are produced by cold forging. More specifically, after forming a rod-shaped (cylindrical) material by cold forging, the material is formed into a prescribed shape by machining. In other words, portions having a prescribed shape in the roller lifter, such as the portion that holds the roller, the portion that forms the guide surfaces, and the portion that supports the plunger, are formed by machining a material formed by cold forging.

In this manner, according to a roller lifter produced by cold forging, although the number of constituent parts is less than the previously described configuration of JP-A-9-125915, numerous machining steps are required after cold forging. Namely, since there are limitations on the shapes that can be formed by cold forging, it is difficult to form portions having a prescribed shape such as the portion that holds the roller by cold forging alone. Thus, since cold forging only enables parts to be formed to a shape that is far removed from a final target shape (finished product shape), cold forging requires numerous machining steps. Consequently, the number of production steps increases resulting in increased costs.

In addition, it is difficult to realize both lightweight and reduced costs in the case of a roller lifter produced by cold forging. Namely, since there are limitations on the shapes that can be formed by cold forging as previously described, a relatively large surplus portion (surplus material) remains in the material after forming, and that surplus material serves to impair weight reduction of the finished product. Although this surplus material can be removed by increasing the number of machining steps, an increase in the number of machining steps results an increased costs.

On the other hand, there are cases in which a rotation stopper in the form of a portion having a shape for preventing rotation of the roller lifter is provided in the roller lifter for preventing rotation of a roller lifter in which the direction of reciprocating motion of the roller lifter is the direction of the axis of rotation. In other words, the rotation stopper is a portion having a shape for preventing relative rotation of the roller lifter with respect to a member in which a reciprocating roller lifter is enclosed. The rotation stopper is provided from the viewpoint of maintaining urging of the roller to contact the cam and preventing uneven wear at contacting portions of the roller and cam.

It is difficult to form such a rotation stopper by cold forging since there are limitations on the shapes that can be formed by cold forging as previously described. Therefore, there are cases in which it is necessary to provide a separate member from the material formed by cold forging in order to provide a rotation stopper in the roller lifter. In such cases, both production steps and costs increase due to the need for machining steps for fabricating the separate member and forming a portion having a shape corresponding to the separate member (such as a hole) in the material after forming.

SUMMARY OF THE INVENTION

With the foregoing in view, the invention provides a roller lifter that allows portions having a prescribed shape, such as a portion that holds a roller, to be formed from an integral material by press forming or other sheet metal forming, and which together with being able to considerably reduce both the number of production steps and cost, enables a compact and lightweight structure to be easily realized, a method of producing the roller lifter, and a liquid pump provided with the roller lifter.

Therefore, according to one aspect of the invention, a roller lifter is provided having a roller that is rotatably supported and a body that supports the roller, wherein the body has: a base portion in the form of a flat plate; a roller holding portion in the form of a pair of opposing plate-shaped portions that are formed by bending towards one of plate surfaces of the base portion, the roller holding portion being configured to hold the roller between the plate-shaped portions; and a guide portion in the form of a plate-shaped portion formed by bending towards the other one of the plate surfaces of the base portion and also formed by curving so that the plate-shaped portion follows a cylindrical surface shape in which a direction perpendicular to the plate surface of the base portion is the axial direction of the cylinder, the guide portion being configured to form a guide surface in a shape that follows the cylindrical surface shape.

In addition, in the above-mentioned roller lifter, the body is preferably also provided with a rotation stopper in the form of a plate-shaped portion that is movably enclosed in a guide member having a surface of contact with the guide surfaces and protrudes from the body towards the outside of the cylindrical surface shape in the radial direction, the rotation stopper being configured to prevent relative rotation, with respect to the guide member, of the body having the axial direction of the cylinder as the direction of the axis of rotation, by engaging with the guide member.

In addition, in the above-mentioned roller lifter, the rotation stopper is provided in the form of a portion that is formed by bending at an end portion at least either in a direction of one of the plate surfaces or the other one of the plate surfaces in a plate-shaped portion that constitutes the guide portion.

In addition, in the above-mentioned roller lifter, the rotation stopper is also preferably provided in the form of an extending portion extending from the base portion.

In addition, in the above-mentioned roller lifter, the plate-shaped portion that configures the guide portion has end portions that mutually make contact in the circumferential direction with respect to the cylindrical surface shape.

In addition, the plate-shaped portion that configures the guide portion also preferably has a gap between end portions in the circumferential direction with respect to the cylindrical surface shape.

In addition, in the above-mentioned roller lifter, the guide portion is a portion that is elongated from the plate-shaped portion that configures the guide portion in the direction toward one of the plate surfaces, the guide portion further having an extending portion that causes the guide surface to extend in the direction of one of the plate surfaces.

In addition, in the above-mentioned roller lifter, if the length of the extending portions is roughly equal to the width of the plate-shaped portion, inclination of the orientation of the roller lifter during reciprocating motion of the roller lifter is inhibited, thereby making this preferable.

According to a different aspect of the invention, in a method of producing a roller lifter having a roller that is rotatably supported, a method of producing a roller lifter is provided that includes: a material preparation step of preparing a material in the form of a flat plate having a first portion that configures a base portion in the form of a flat plate, a second portion which is in the form of a pair of portions that protrude from the first portion in mutually opposite directions, and which configures a roller holding portion that holds the roller therebetween in an opposed state, and a third portion which is in the form of a portion that protrudes from the first portion in at least a direction that intersects the protruding direction of the second portion, and which configures a guide portion that forms a guide surface of a shape that follows a cylindrical surface shape in which a direction perpendicular to the plate surfaces of the base portion is the axial direction of the cylinder; a first forming step of forming the roller holding portion by bending the second portion towards one of the plate surfaces of the material with respect to the first portion; and a second forming step of forming the guide portion by bending the third portion towards the other one of the plate surfaces of the material with respect to the first portion and curving so that the guide portion follows the cylindrical surface shape.

In addition, in the above-mentioned method of producing a roller lifter, the second forming step preferably further forms a protruding portion that protrudes towards the outside of the cylindrical surface shape in the radial direction in order to function as a rotation stopper for preventing relative rotation, with respect to the guide member, of the body having the axial direction of the cylinder as the direction of the axis of rotation, by engaging with the guide member.

In addition, in the above-mentioned method of producing a roller lifter, if the first forming step and the second forming step are all carried out by press forming, the number of production steps and costs can be reduced, thereby making this preferable.

In addition, in the above-mentioned method of producing a roller lifter, the body of the roller lifter is preferably formed from an integrated plate-shaped material having the first portion, the second portion and the third portions.

In addition, a liquid pump is provided having the above-mentioned roller lifter or a roller lifter produced according to the above-mentioned method of producing a roller lifter, and the liquid pump is further provided with a plunger that pumps a liquid by reciprocating motion; a cam that reciprocates the plunger by rotating; and an elastic member that urges the plunger in a direction of the reciprocating motion toward the cam, wherein the roller lifter supports the plunger by means of the base portion, and contacts the cam through the roller in a state of being urged in the direction toward the cam by the elastic member.

The invention demonstrates the following effects. Namely, according to the invention, with respect to a roller lifter provided with a rotatably supported roller, since portions having a prescribed shape, such as a portion that holds the roller, can be formed by sheet metal forming such as press forming from an integral material, the number of production steps and costs can be reduced considerably and a compact and lightweight structure can be realized easily.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

The invention attempts to form a body having a portion of a prescribed shape such as a portion that supports a roller in a roller lifter by sheet metal forming such as press forming by contriving the sheet-like shape of a flat sheet-shaped material capable of being press formed. The following provides an explanation of embodiments of the invention. Furthermore, in the embodiments explained below, explanations are provided for the case of the roller lifter as claimed in the invention being applied to a high-pressure fuel pump composing a fuel supply system of an automobile engine.

Figure 1:
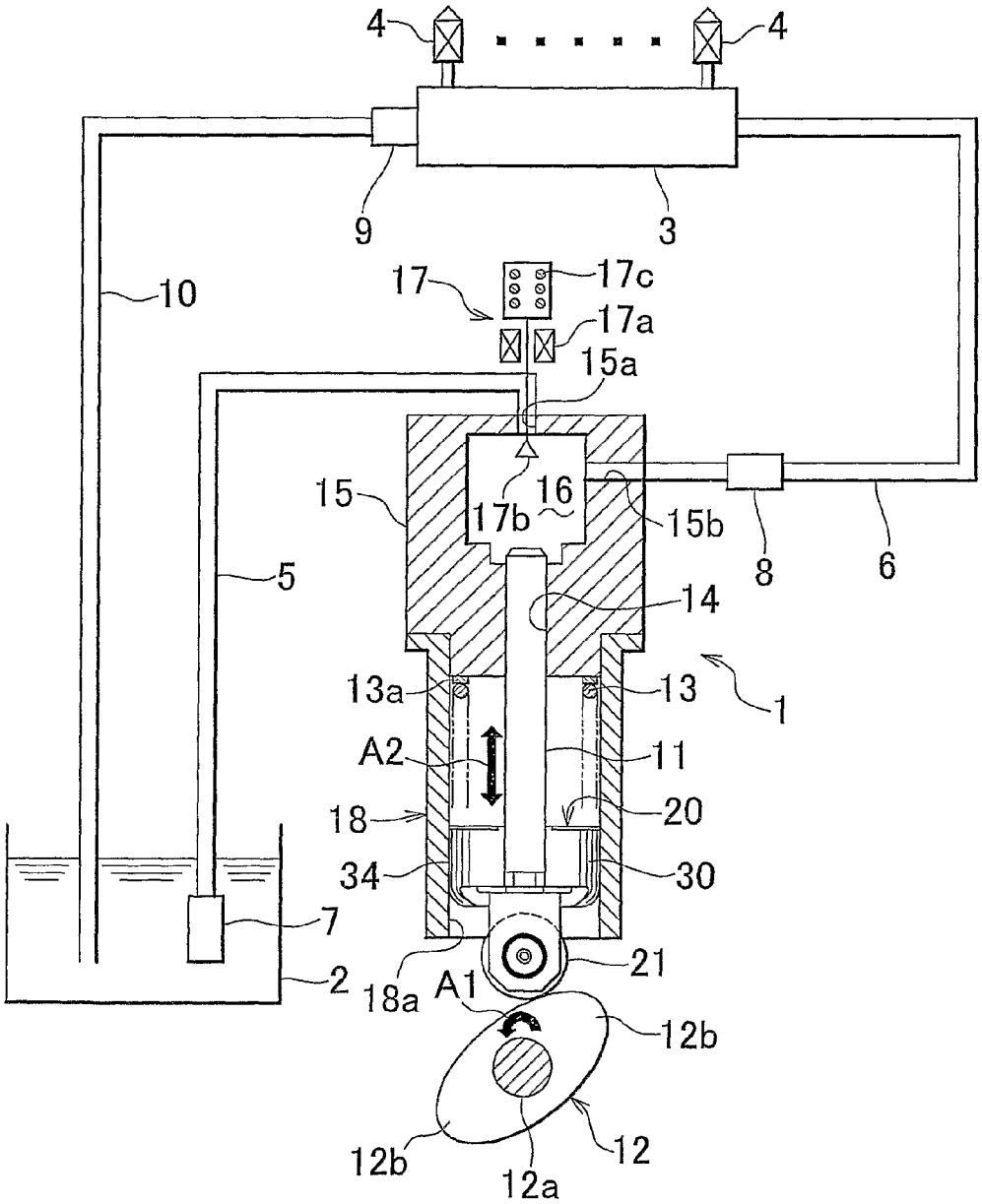
FIG. 1 is a drawing showing the configuration of a fuel supply system of an automobile engine provided with a high-pressure fuel pump as claimed in a first embodiment of the invention.
Figure 2:
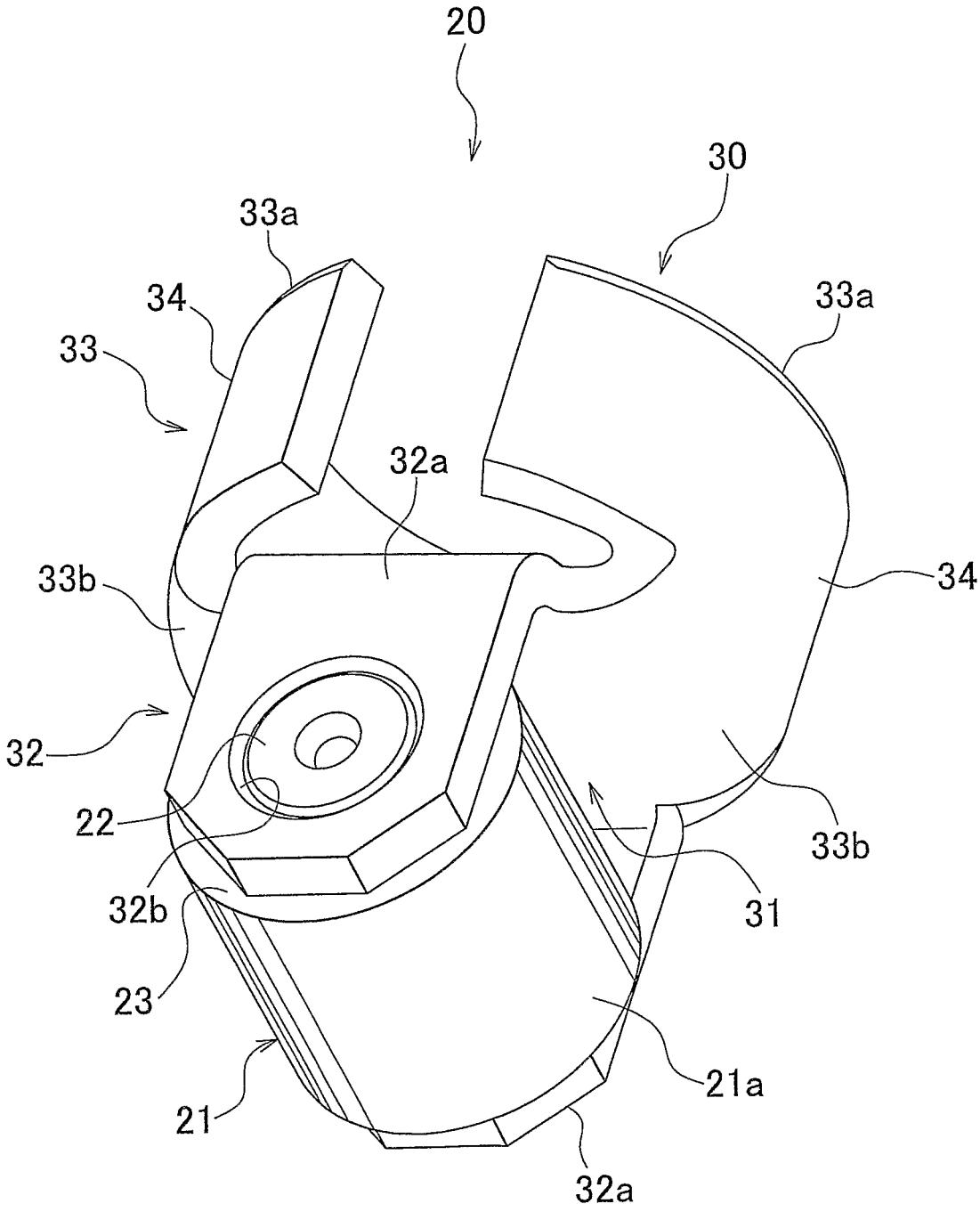
FIG. 2 is a perspective view of a roller lifter as claimed in a first embodiment of the invention.

First, an explanation is provided of a high-pressure fuel pump 1 as claimed in a first embodiment using FIG. 1. The high-pressure fuel pump 1 is for pumping fuel in a fuel tank 2 in the form of fuel injected from an injector 4 connected to a delivery pipe (pressure accumulator) 3 at high pressure in a fuel supply system of an automobile engine. Thus, the high-pressure fuel pump 1 is such that the fuel intake side is connected to the fuel tank 2 via a low-pressure fuel path 5, and the fuel delivery side is connected to the delivery pipe 3 via a high-pressure fuel path 6.

Fuel inside the fuel tank 2 is suctioned up by a feed pump 7 and delivered towards the low-pressure fuel path 5. The feed pump 7 is provided in a state of being connected to the low-pressure fuel path 5 within the fuel tank 2. A check valve 8 is provided in the high-pressure fuel path 6 for preventing backflow of fuel delivered from the high-pressure fuel pump 1. Fuel that has been pumped from the high-pressure fuel pump 1 to the delivery pipe 3 through the high-pressure fuel path 6 is injected accompanying drive control of the injector 4 and then supplied in prescribed aliquots to the combustion chamber of each cylinder of an engine.

A relief path 10 is connected to the delivery pipe 3 via a relief valve 9. The relief path 10 communicates with the fuel tank 2. The relief valve 9 is a pressure control valve that controls pressure by allowing a portion of the fuel to escape when the fuel pressure has become equal to or greater than a set pressure. Thus, when the fuel in the delivery pipe 3 reaches a set pressure, the relief valve 9 is opened and a portion of the fuel inside the delivery pipe 3 passes through the relief path 10 and is returned to the fuel tank 2. A fuel supply device is configured in an automobile engine by employing a configuration that contains the high-pressure fuel pump 1 in this manner.

The high-pressure fuel pump 1 is provided with a plunger 11, a cam 12, a coil spring 13 and a roller lifter 20. The plunger 11 pumps liquid in the form of fuel by reciprocating. The plunger 11 is provided inserted in a cylinder 14 possessed by the high-pressure fuel pump 1 while able to reciprocate. The cylinder 14 is a portion that is formed in the form of an opening in a body 15 that composes the body portion of the high-pressure fuel pump 1.

A pressurizing chamber 16 is formed within the body 15. The pressurizing chamber 16 is formed by the inner wall surfaces of the body 15 that form a spatial portion that communicates with the cylinder 14, and the end surface and the like on one end of the plunger 11. The pressuring chamber 16 communicates with the low-pressure fuel path 5 via an intake port 15*a* formed in the body 15, and communicates with the high-pressure fuel path 6 via a delivery port 15*b* similarly formed in the body 15.

A solenoid spill valve 17 is provided in the intake port 15*a*. Namely, when the solenoid spill valve 17 is open, the low-pressure fuel path 5 and the pressurizing chamber 16 communicate and fuel that has passed through the low-pressure fuel path 5 is introduced into the pressurizing chamber 16 through the solenoid spill valve 17. On the other hand, when the solenoid spill valve 17 is closed, the low-pressure fuel path 5 and the pressurizing chamber 16 are isolated, and introduction of fuel into the pressurizing chamber 16 is interrupted.

The solenoid spill valve 17 has a solenoid coil 17*a*, a valve body 17*b* and a coil spring 17*c*, and the solenoid spill valve 17 is switched between open and closed based on whether or not power is supplied thereto. More specifically, when power is not supplied to the solenoid coil 17*a*, the valve body 17*b* is moved away from the intake port 15*a* (seat portion formed in the opening thereof) by urging force of the coil spring 17*c*, or in other words, the solenoid spill valve 17 is open. On the other hand, when power is supplied to the solenoid coil 17*a*, the valve body 17*b* blocks the intake port 15*a* (covers the seat portion thereof) in opposition to the urging force of the coil spring 17*c*, or in other words, the solenoid spill valve 17 is closed.

As a result of the solenoid spill valve 17 being closed at the timing at which the reciprocating plunger 11 moves toward the pressuring chamber 16 (upper side in FIG. 1), the fuel pressure within the pressurizing chamber 16 rises and fuel within the pressurizing chamber 16 is pumped towards the high-pressure fuel path 6 through the delivery port 15*b*. In addition, as a result of the solenoid spill valve 17 being opened at the timing at which the reciprocating plunger 11 moves toward the side of being pushed out from the body (lower side in FIG. 1), fuel pressure within the pressuring chamber 16 lowers and fuel is suctioned from the low-pressure fuel path 5 into the pressurizing chamber 16 through the intake port 15*a*. Control of opening and closing of the solenoid spill valve 17 in this manner is carried out by, for example, an electronic control device such as an electronic control unit (ECU) comprehensively carrying out electrical control of the engine.

The cam 12 causes the plunger 11 to reciprocate by rotating. The cam 12 is formed on a camshaft 12*a* rotatably supported at a prescribed position. Thus, the cam 12 integrally rotates with the camshaft 12*a*, having a common location for the center of the axis of rotation therewith, accompanying rotation of the camshaft 12*a*. The cam 12 has two cam noses 12*b* separated by an angle of 180° about the center of the axis of rotation of the camshaft 12*a*. The plunger 11 reciprocates (see arrow A2) due to rotation of the cam 12 (see arrow A1) accompanying rotation of the camshaft 12*a*.

The coil spring 13 functions as an elastic member for urging the plunger 11 in the reciprocating direction that faces the cam 12 (to be referred to as the "cam direction"). The coil spring 13 is provided so that the central axis thereof coincides with the axial center of the plunger 11. One end of the coil spring 13 is supported by the body 15 via a spring seat 13*a*.

The roller lifter 20 is interposed between the plunger 11 and the cam 12. The roller lifter 20 supports one end of the plunger 11 and contacts the cam 12 while in the state of being urged in the cam direction by the coil spring 13 for urging the plunger 11. Consequently, the other end of the coil spring 13, of which one end is supported by the body 15 as previously described, is supported by the roller lifter 20 as a result of being mediated directly by the roller lifter 20 or by another member such as a seat member.

In other words, as a result of being mediated by the roller lifter 20, the plunger 11 receives rotation of the cam 12 together with being urged in the cam direction. Thus, the roller lifter 20 reciprocates with the plunger 11 accompanying rotation of the cam 12. The roller lifter 20 is mediated by a rotating body in the form of a roller 21 during contact with the cam 12. Consequently, the roller lifter 20 is provided with the rotatably supported roller 21 and a body 30 that supports the roller 21.

In the roller lifter 20, the roller 21 is in a state in which the outer peripheral surface thereof is in contact with the outer peripheral surface of the cam 12 when supported such that the direction of the axis of rotation is the same as (parallel to) that of the cam 12. While in this state, plunger 11 mediated by the roller lifter 20 reciprocates accompanying rotation of the cam 12, or in other words, moves in the direction in opposition to the urging force applied by the coil spring 13 of the plunger 11 (upward direction in FIG. 1), and in the opposite direction thereof (downward direction in FIG. 1). Here, the roller 21 when in contact with the cam 12 rotates due to frictional force and the like in response to rotation of the cam 12.

Movement (reciprocating motion) of the roller lifter 20 is guided by a lifter guide 18. The lifter guide 18 is a cylindrical member in which the roller lifter 20 is installed, and of which one end is supported while fixed to the body 15. Thus, the roller lifter 20 reciprocates within the lifter guide 18 mediated by the body 30 while in contact with an inner peripheral surface 18*a* of the lifter guide 18.

As has been described above, in a high-pressure fuel pump 1 as claimed in the first embodiment, the roller lifter 20 provided with the roller 21 and the body 30 is present between the plunger 11 and the cam 12. The following provides a detailed explanation of the configuration of the roller lifter 20.

As was previously described, the roller lifter 20 is provided with the roller 21 and the body 30. The body 30 is a member configured by bending an integral flat plate-shaped material. As shown in FIGS. 2 to 5, the body 30 has a base portion 31, a roller holding portion 32 and a guide portion 33.

Figure 5:
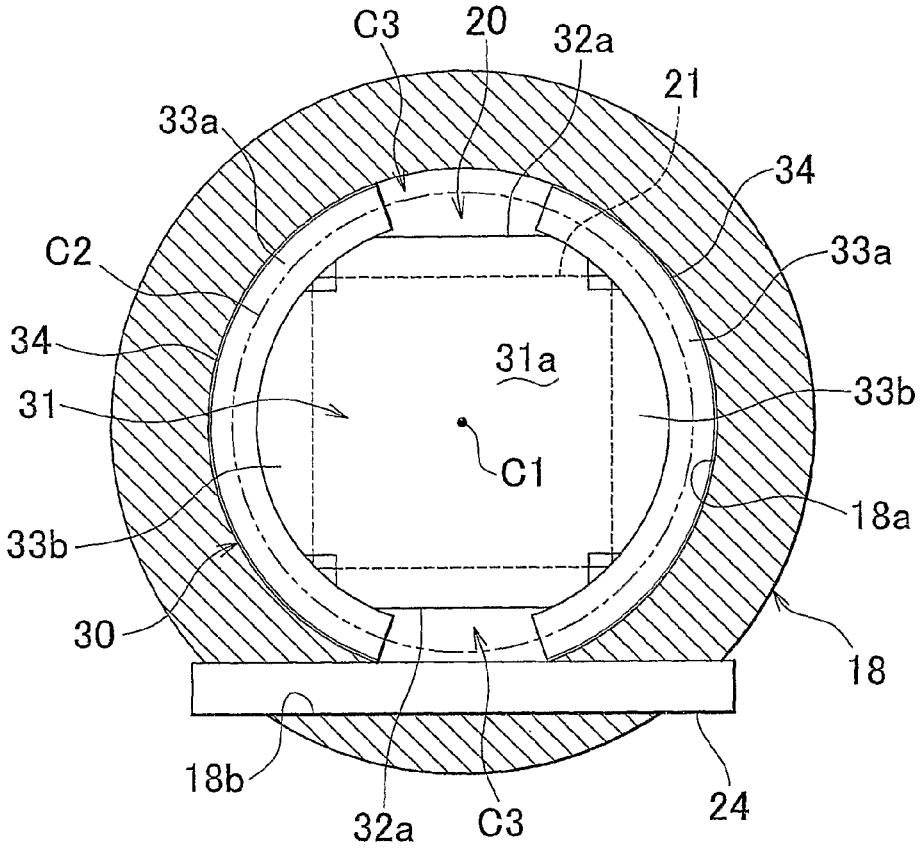
FIG. 5 is an overhead partial cross-sectional view showing the configuration of a rotation stopper of a roller lifter as claimed in the first embodiment.

The base portion 31 is a flat plate-shaped portion. The base portion 31 serves as a portion that is contacted by one end of the plunger 11 in the state in which the roller lifter 20 is interposed between the plunger 11 and the cam 12. More specifically, in the base portion 31, one plate surface (upper surface in FIG. 4) is a surface on the side contacted by the plunger 11 (to be referred as the "plunger contact surface 31*a*"). In the first embodiment, the base portion 31 is a roughly rectangular shaped portion as shown in FIG. 5, for example. Furthermore, in the following explanation, the orientation on the side of the plunger 11 (side of the plunger contact surface 31*a*) in the roller lifter 20 is designated as "up" while the cam 12 side (side of the plate surface opposite from the plunger contact surface 31*a*) is designated as "down" in the state in which the roller lifter 20 is interposed between the plunger 11 and the cam 12.

The roller holding portion 32 consists of a pair of opposing plate-shaped portions formed by bending one of the plate surfaces (plate surface opposite from the plunger contact surface 31*a*) of the base portion 31. Thus, the roller holding portion 32 has a pair of opposing plate-shaped portions in the form a pair of supporting plates 32*a*. The supporting plates 32*a* are portions that extend downward from a pair of opposing side edges of the roughly rectangular shaped base portion 31 as previously described in a direction roughly perpendicular to the plate surface of the base portion 31. In other words, the pair of supporting plates 32*a* is opposed roughly in parallel. In the first embodiment, the supporting plates 32*a* have a roughly rectangular shape in which the corners of the distal end (lower side) thereof are beveled.

The roller holding portion 32 holds the roller 21 between the pair of supporting plates 32*a*. Namely, the roller holding portion 32 rotatably supports the roller 21 in a state in which the roller 21 is clamped by the two opposing supporting plates 32*a*. Thus, in the roller holding portion 32, the opposing direction of the supporting plates 32*a* (vertical direction in FIG. 5) is the axial direction of the cylinder of the roller 21 having a cylindrical external shape. In other words, in the roller holding portion 32, the roller 21 is supported while oriented such that the direction of the axis of rotation thereof is the opposing direction of the supporting plates 32*a*. Supporting holes 32*b* are formed in the supporting plates 32*a* for supporting the roller 21.

The roller 21 has a cylindrical external shape as previously described, and the outer peripheral surface thereof is the surface that contacts the cam 12 (to be referred to as the "cam contact surface 21*a*"). The roller 21 has a shaft supporting portion 22 that has the rotating shaft of the roller 21, and a portion that composes the outer peripheral portion of the roller 21 and forms the cam contact surface 21*a* in the form of an outer peripheral portion 23. In other words, the roller 21 is held in a state of being supported between the shaft supporting portion 22 and the supporting plates 32*a* in the roller holding portion 32. Here, the supporting holes 32*b* possessed by the supporting plates 32*a* are used to support the shaft supporting portion 22.

In the roller 21, a roller bearing is suitably composed by the shaft supporting portion 22 and the outer peripheral portion 23. Namely, in the case a roller bearing is composed by the shaft supporting portion 22 and the outer peripheral portion 23, although not shown in the drawings, a plurality of rolling bodies are contained while allowing to roll freely between the shaft supporting portion 22 and the outer peripheral portion 23. More specifically, in the case where a plurality of spheres are contained as rolling bodies, a roller bearing is composed in the form of a ball bearing and a plurality of needle-shaped bodies are contained as rolling bodies, the roller bearing is composed in the form of a needle bearing. However, there are no particular limitations on the configuration of the roller 21. The configuration of the roller 21 may also be, for example, a configuration in which an integral member is rotatably axially supported in the roller holding portion 32 (configuration in which the shaft supporting portion 22 and the outer peripheral portion 23 rotate integrally).

The guide portion 33 is a plate-shaped portion that is formed by bending the other plate surface of the base portion 31 (plate surface opposite from the one of the plate surfaces previously described, namely the plunger contact surface 31*a*), and curving so as to follow a cylindrical surface shape in which the direction perpendicular to the plate surface of the base portion 31 is the axial direction of the cylinder. The guide portion 33 has curved plate-shaped portions in the form of curved portions 33*a*. The curved portions 33*a* are portions that extend upward while having coupling portions 33*b* interposed between the curved portions 33*a* and the base portion 31. In other words, the coupling portions 33*b* are portions that connect the curved portions 33*a* with the base portion 31, and are curved portions of the guide portion 33 with respect to the base portion 31.

In the first embodiment, the guide portion 33 has a pair of curved portions 33*a*. This pair of curved portions 33*a* is opposed in a direction that intersects the direction in which the supporting plates 32*a* that compose the roller holding portion 32 are opposed. In other words, the pair of curved portions 33*a* extend upward mediated by the coupling portions 33*b* from another opposing pair of side edges other than the pair of opposing side edges from which the supporting plates 32*a* extend in the roughly rectangular base portion 31.

The cylindrical surface shape that is followed when the curved portions 33*a* composing the guide portion 33 are curved has a direction perpendicular to the plate surface of the base portion 31, namely the vertical direction, as the axial direction of the cylinder. In addition, the cylindrical surface shape followed by the curved portions 33*a* is such that the position of the cylinder axis (central axis) is roughly the center position of the base portion 31. Namely, the cylindrical surface shape followed by the curved portions 33*a* is represented by a circle C2 indicated with a double dot broken line having for the center point thereof a point C1 located roughly in the center of the base portion 31 in the overhead view (planar view) of the roller lifter 20 shown in FIG. 5. Thus, the curved portions 33*a* are plate-shaped portions curved into an arcuate shape when viewed from overhead.

Figure 3:
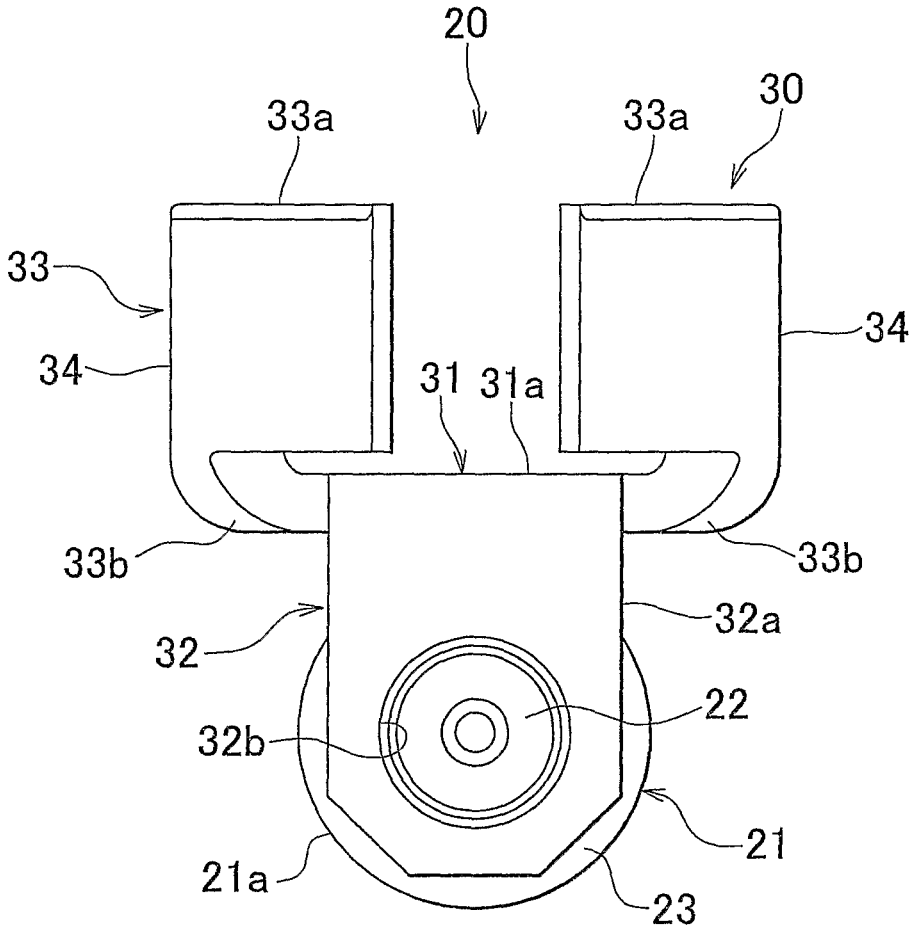
FIG. 3 is a side view of a roller lifter as claimed in the first embodiment.
Figure 4:
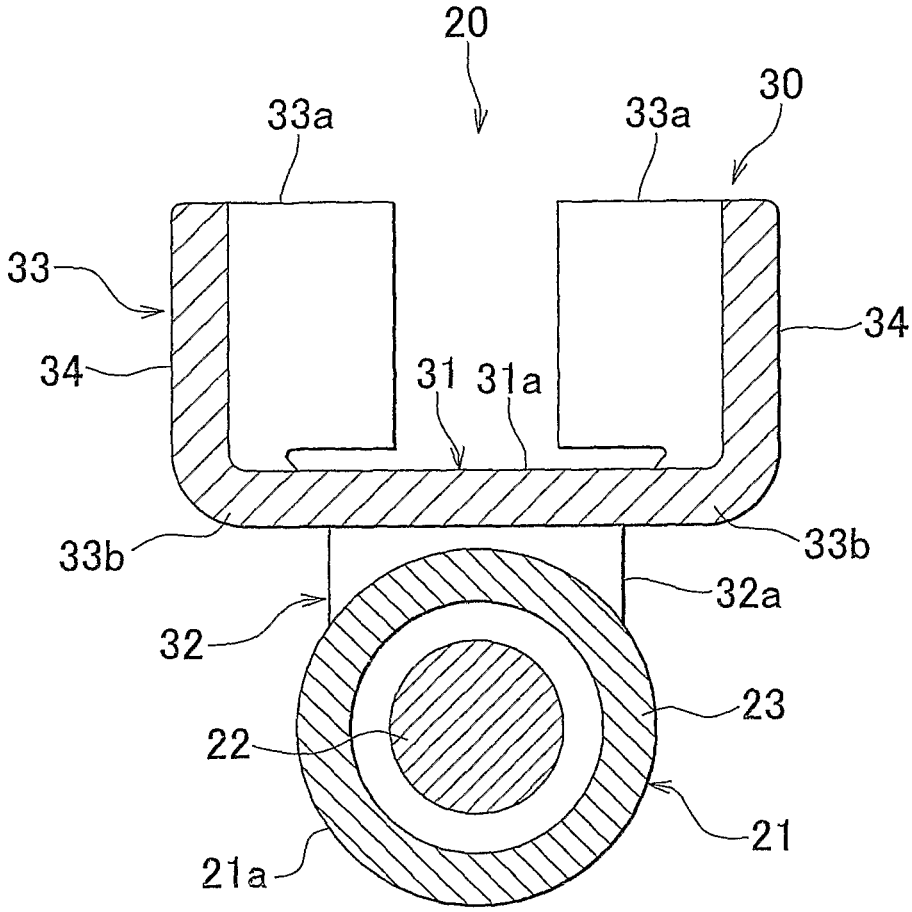
FIG. 4 is a side cross-sectional view of a roller lifter as claimed in the first embodiment.

In the first embodiment, the pair of opposing curved portions 33*a* are formed to have a mutually linearly symmetrical shape in the view along the direction of the axis of rotation of the roller 21 shown in FIG. 3 and in the overhead view shown in FIG. 5. More specifically, each of the curved portions 33*a* is formed by distal ends of the coupling portions 33*b*, extending upward from side edges of the base portion 31, being extended for roughly the same length in both lateral directions along a common cylindrical surface shape (see circle C2, to apply similarly hereinafter). Between the opposing curved portions 33*a*, gaps C3 are present between the ends in the circumferential direction of the cylindrical surface shape (see FIG. 5). The gaps C3 between the curved portions 33*a* are present at opposing positions in opposing direction of the pair of supporting plates 32*a* (direction of the axis of rotation of the roller 21).

The guide portion 33 forms guide surfaces 34 of a shape that follows the cylindrical surface shape. The guide surfaces 34 are formed by the outer peripheral surfaces of the curved portions 33*a* that compose the guide portion 33. Namely, plate-shaped portions that follow the cylindrical surface shape as previously described in the form of the outer peripheral surfaces of the curved portions 33*a* partially have the shape of a cylindrical surface. Therefore, the outer peripheral surfaces of the curved portions 33*a* serve as the guide surfaces 34 formed by the guide portion 33.

In the overhead view shown in FIG. 5, the guide surfaces 34 are the outermost surfaces in the roller lifter 20. In other words, in the overhead view shown in FIG. 5, another portion including the guide portion 33 and the roller 21 are contained in the body 30 to the inside of the circular shape followed by the guide surfaces 34 formed by the guide portion 33.

The guide surfaces 34 contact the inner peripheral surface 18*a* of the lifter guide 18 in the state in which the roller lifter 20 is contained within the lifter guide 18 (see FIG. 1). In other words, the inner peripheral surface 18*a* of the lifter guide 18 serves as a contact surface with the guide surfaces 34 possessed by the roller lifter 20 (sliding contact surfaces of the roller lifter 20). Thus, the size of the cylindrical surface shape followed by the guide surfaces 34 corresponds to the size of the cylindrical surface shape possessed by the inner peripheral surface 18*a* of the lifter guide 18.

The roller lifter 20, provided with the configuration described above, supports the plunger 11 from one end with the base portion 31 having the plunger contact surface 31*a* between the plunger 11 and the cam 12, and contacts the cam 12 mediated by the roller 21 having the cam contact surface 21*a* while being urged in the direction of the cam by the coil spring 13. The roller lifter 20 reciprocates (slides) within the lifter guide 18 in the state in which the guide surfaces 34 are in contact with the inner peripheral surface 18*a* of the lifter guide 18 accompanying rotation of the cam 12. The plunger 11 then reciprocates accompanying this reciprocating motion.

In addition, a rotation stopper is provided for the roller lifter 20 of the first embodiment. The rotation stopper employs a configuration for preventing rotation relative to the lifter guide 18 of the roller lifter 20 having the direction of reciprocating motion of the roller lifter 20 (vertical direction)

as the direction of the axis of rotation (to be referred to as "relative rotation"). An example of a configuration employed for the rotation stopper in the first embodiment is described below.

As shown in FIG. 5, a rotation stopper bar 24 is used as a rotation stopper of the roller lifter 20. The rotation stopper bar 24 is a bar-shaped member that is provided driven into the lifter guide 18 containing the roller lifter 20 and which restricts relative rotation of the roller lifter 20.

More specifically, as shown in the overhead view of FIG. 5, the rotation stopper bar 24 is provided in a direction roughly tangent to the cylindrical surface shape (circular shape) of the guide portion 33 of the roller lifter 20. Here, the rotation stopper bar 24 is driven in at a position so as to be contacted by outside (outside of the cylindrical surface shape) corners formed on the ends of both curved portions 33*a* at the portion of the gap C3 formed between ends of the pair of curved portions 33*a* that compose the guide portion 33 as previously described.

Consequently, as shown in the overhead of FIG. 5, the rotation stopper bar 24 is provided so as to be roughly perpendicular to the opposing directions of the gap C3 at two locations in the same direction as the opposing direction (rotational direction of the roller 21) of the pair of supporting plates 32*a* as previously described. In addition, the rotation stopper bar 24 is provided at one of the gaps C3 (lower gap C3 in FIG. 5) among the two gaps C3.

The rotation stopper bar 24 is provided in a state of being inserted into an insertion hole 18*b* formed in the lifter guide 18. The insertion hole 18*b* is formed corresponding to the direction of the rotation stopper bar 24 relative to the roller lifter 20 in the state of being contained in the lifter guide 18. Thus, as shown in the overhead view of FIG. 5, the insertion hole 18*b* is formed in a direction roughly tangent to the inner peripheral surface 18*a* of the lifter guide 18. As a result of driving (press-fitting) the rotation stopper bar 24 into the insertion hole 18*b*, the rotation stopper bar 24 is provided in a state of being fixed in the lifter guide 18.

In this manner, the relative rotation of the roller lifter 20 is restricted by the rotation stopper bar 24 provided with respect to the lifter guide 18. More specifically, relative rotation of the roller lifter 20 is restricted since outside corners (outside of the cylindrical surface shape) formed on the ends of the pair of curved portions 33*a* in the portion of the gap C3 present between the ends of the both curved portions 33*a* make contact with the rotation stopper bar 24.

Continuing, an explanation is provided of a method of producing the roller lifter 20. The production method as claimed in the first embodiment is a method of producing the roller lifter 20 provided with a rotatably supported roller 21 that includes a step for preparing a flat plate-shaped material (to be referred to as a "material preparation step"), a step for forming the roller holding portion 32 (to be referred to as a "first forming step") and a step for forming the guide portion 33 (to be referred to as a "second forming step").

Figure 6:
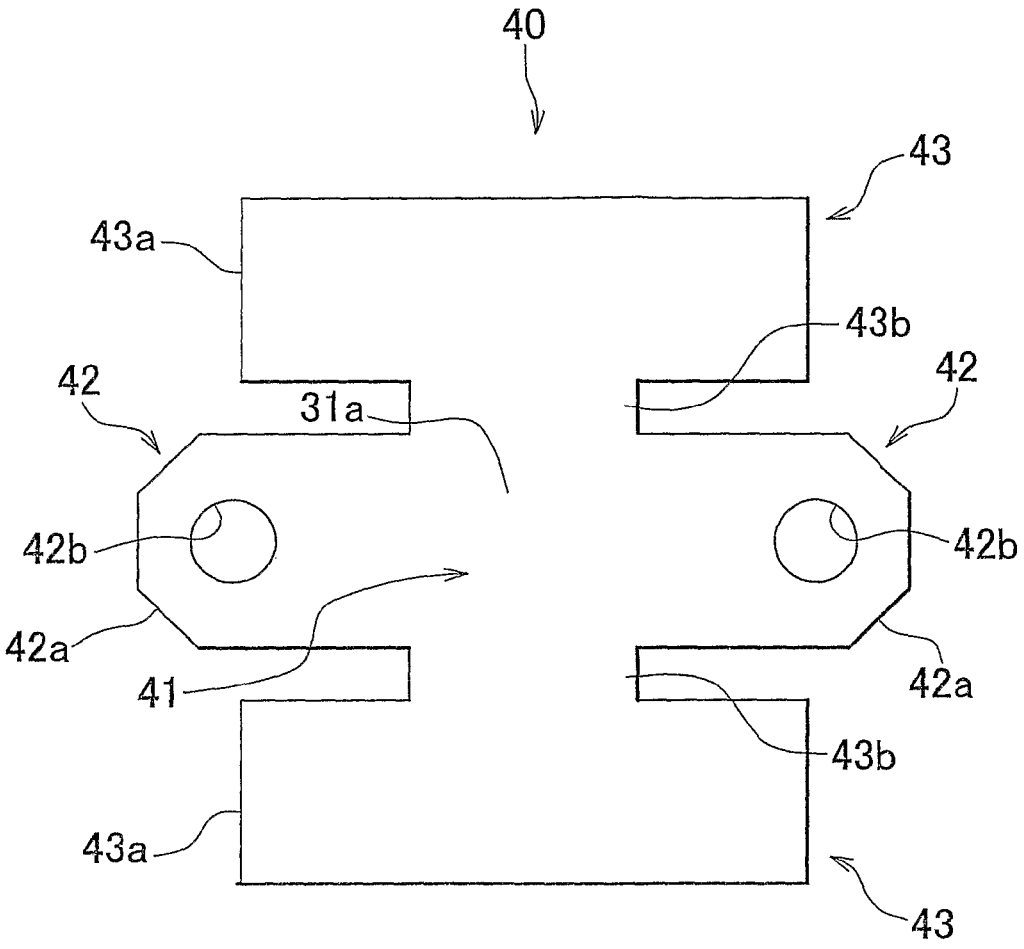
FIG. 6 is a drawing showing a plate-shaped material as claimed in a first embodiment of the invention.

In the material preparation step, as shown in FIG. 6, a plate-shaped material 40 that can be subjected to sheet metal processing such as press forming is prepared for use as the flat plate-shaped material. The plate-shaped material 40 is produced by stamping out from sheet metal. The portion of the body 30 of the roller lifter 20 is composed by bending the plate-shaped material 40 by press forming and the like. Thus, the plate-shaped material 40 has a portion that composes the base portion 31 in the body 30 of the roller lifter 20 in the form of a first portion 41, a portion that composes the roller holding portion 32 in the body 30 in the form of a second portion 42, and portions that compose the guide portion 33 in the body 30 in the form of third portions 43.

The first portion 41 composes the flat plate-shaped base portion 31. Thus, the first portion 41 is a portion that fauns the central portion of the plate-shaped material 40 over a range corresponding to the roughly rectangular base portion 31. The plate surface on one side of the first portion 41 (front side in FIG. 6) becomes the plunger contact surface 31*a* possessed by the base portion 31. In the following explanations, the side on which the plunger contact surface 31*a* is formed in the plate-shaped material 40 is referred to as the "front side", while the opposite side is referred to as the "back side".

The second portion 42 consists of a pair of portions that protrude from the first portion 41 in mutually opposite directions. More specifically, as shown in FIG. 6, the plate-shaped material 40 has a pair of projections 42*a* that compose the second portion 42. One of the projections 42*a* protrudes towards one side (left or right side in FIG. 6) from the first portion 41, while the other projection 42*a* protrudes towards the other side (other left or right side in FIG. 6) from the same first portion 41. In other words, the pair of projections 42*a* composing the second portion 42 protrudes in the directions of both sides (both the left and right in FIG. 6) which are in mutually opposite directions.

The projections 42*a* are portions corresponding to the supporting plates 32*a* that compose the roller holding portion 32 in the body 30 of the roller lifter 20. Thus, the projections 42*a* have a roughly rectangular shape in which corners on the ends in the protruding direction from the first portion 41 are beveled. Furthermore, a through hole 42*b* corresponding to the supporting hole 32*b* used to support the roller 21 is formed in each projection 42*a*.

The second portion 42 in the form of the pair of projections 42*a* composes the roller holding portion 32 that holds the roller 21 mutually there between in an opposed state. Namely, the pair of projections 42*a* are made to be in a mutually opposed state by bending to the back side with respect to the first portion 41. The roller 21 is then rotatably supported between the opposing projections 42*a*.

The third portions 43 are portions that protrude in a direction that intersects the protruding direction of the second portion 42 from the first portion 41. More specifically, as shown in FIG. 6, the third portions 43 have strip-like portions 43*a* having for the lengthwise direction thereof the protruding direction of the second portion 42 from the first portion 41 (horizontal direction in FIG. 6). The strip-like portions 43*a* are portions that protrude from the first portion 41 mediated by connecting portions 43*b* between the strip-like portions 43*a* and the first portion 41. In the first embodiment, roughly the center of the strip-like portions 43*a* in the lengthwise direction is connected to the first portion 41 by the connecting portions 43*b*. Thus, the portions composed of the strip-like portions 43*a* and the connecting portions 43*b* are roughly T-shaped portions.

In the first embodiment, the plate-shaped material 40 has the third portions 43 extending in the directions of both sides (in mutually opposing directions) in the direction that intersects the direction that the second portion 42 protrudes from the first portion 41. Namely, the direction in which the second portion 42 protrudes from the first portion 41 is the horizontal direction in FIG. 6. The direction that intersects the protruding direction of the second portion 42 is the vertical direction in FIG. 6. The plate-shaped material 40 has a pair of portions protruding in the vertical direction in FIG. 6 from the first portion 41 in the form of the third portions 43. Each of this pair of portions is a T-shaped portion composed of a strip-like portion 43*a* and a connecting portion 43*b* as previously described.

The strip-like portions 43*a* are portions corresponding to the curved portions 33*a* composing the guide portion 33 in the body 30 of the roller lifter 20, while the connecting portions 43*b* are portions corresponding to the coupling portions 33*b* also composing the guide portion 33. Thus, the strip-like portions 43*a* have a shape such that the distal ends of the connecting portions 43*b* protruding from the first portion 41 protrude by approximately the same length in the direction perpendicular to the protruding direction of the connecting portions 43*b* (horizontal direction in FIG. 6).

The third portions 43 compose the guide portion 33 that forms the guide surfaces 34 having a shape that follows the cylindrical surface shape having for the direction of the axis of the cylinder thereof the direction perpendicular to the plate surface of the base portion 31. Namely, since the pair of T-shaped portions composed of the strip-like portions 43*a* and the connecting portions 43*b* are bent towards the opposite side (front side) from the projections 42*a* in the form of the second portion 42 with respect to the first portion 41, bent portions in the form of the coupling portions 33*b* are formed by the connecting portions 43*b*. In addition, the curved portions 33*a* are formed by curving the strip-like portions 43*a* into an arcuate shape. The guide surfaces 34 are then formed by the outer peripheral surfaces of the curved portions 33*a*, or in other words, the back sides of the strip-like portions 43*a*.

In the first forming step, the roller holding portion 32 is formed by the second portion 42 being bent towards one of the plate surfaces (back side) of the plate-shaped material 40 with respect to the first portion 41. Namely, in this step, the second portion 42 in the form of the pair of projections 42*a* is bent towards the back side with respect to the first portion 41. Here, since the pair of projections 42*a* are portions that form the supporting plates 32*a* of the roller holding portion 32, they are bent until they are oriented in a roughly parallel opposing state.

The through holes 42*b* possessed by the projections 42*a* are used as the supporting holes 32*b* for supporting the roller 21, and the roller 21 is held between the projections 42*a* in an opposed state. In this manner, the roller holding portion 32 is formed by bending the second portion 42 in the form of the projections 42*a*. Bending of the second portion 42 for forming the roller holding portion 32 in this manner is carried out by sheet metal forming such as press forming.

In the second forming step, the guide portion 33 is formed by bending the third portions 43 towards other plate surface of the plate-shaped material 40 (opposite side (front side) of the side to which the second portion 42 is bent) with respect to the first portion 41 and curving so as to follow the cylindrical surface shape. Namely, the third portions 43 composed of the strip-like portions 43*a* and the connecting portions 43*b* are bent towards the front side with respect to the first portion 41 from the portion of the connecting portions 43*b*. In addition, in this step, the strip-like portions 43*a* of the third portions 43 are curved so as to have an arcuate shape. Here, since the pair of strip-like portions 43*a* are portions that form the curved portions 33*a* of the guide member 33, they are curved so as to follow a common cylindrical surface shape.

In this manner, the guide portion 33 that forms the guide surfaces 34 is formed by bending the third portions 43 from the portions of the connecting portions 43*b* and curving the strip-like portions 43*a*. Bending and curving of the third portions 43 for forming the guide portion 33 in this manner are carried out by sheet metal forming such as press forming.

As has been described above, the roller lifter 20 of the first embodiment is produced by a production method that includes the material preparation step, the first forming step and the second forming step. Furthermore, there are no particular limitations on the chronological order in which the first forming step and the second forming step are carried out. In other words, the first forming step and the second forming step may be carried out with either step carried out first or they may be carried out simultaneously.

In addition in the first embodiment, in plate-shaped material 40 although the third portions 43 in the form of portions composed of the strip-like portions 43*a* and the connecting portions 43*b* protrude in the directions of both sides from the first portion 41 (vertical direction on both sides in FIG. 6), they may also be a portion that protrudes in only one direction (upward or downward direction in FIG. 6). In the case the third portion 43 is a portion that protrudes in only one direction from the first portion 41, the plate-shaped material 40 prepared in the material preparation step has a form like that shown in, for example, FIGS. 7A and 7B.

Figure 7A:
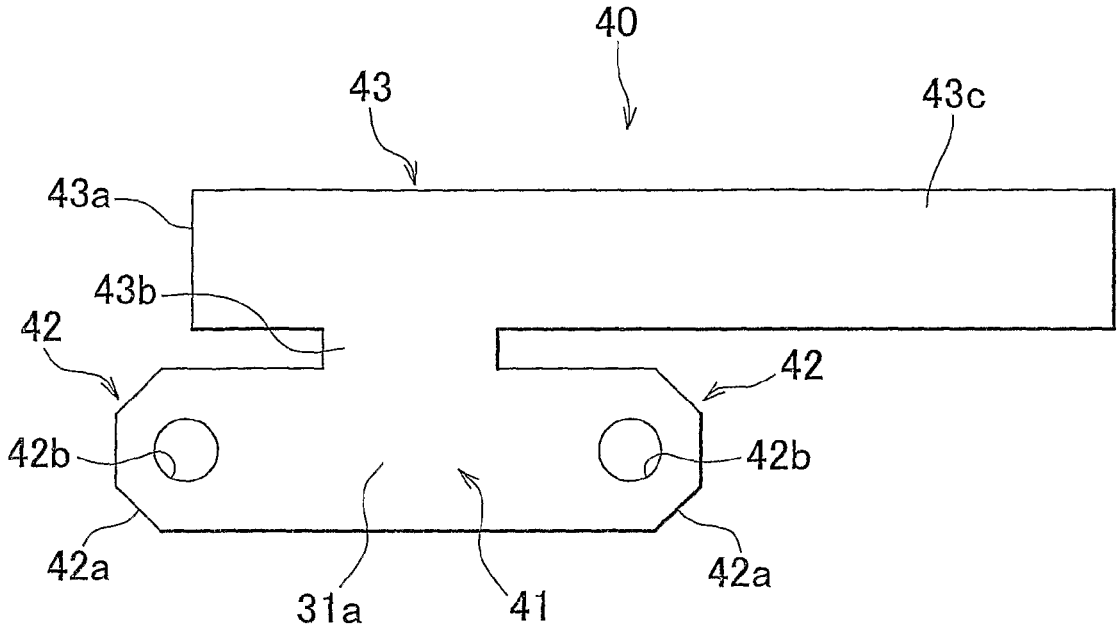
FIGS. 7A and 7B are drawings showing examples of the shape of the plate-shaped material.
Figure 7B:
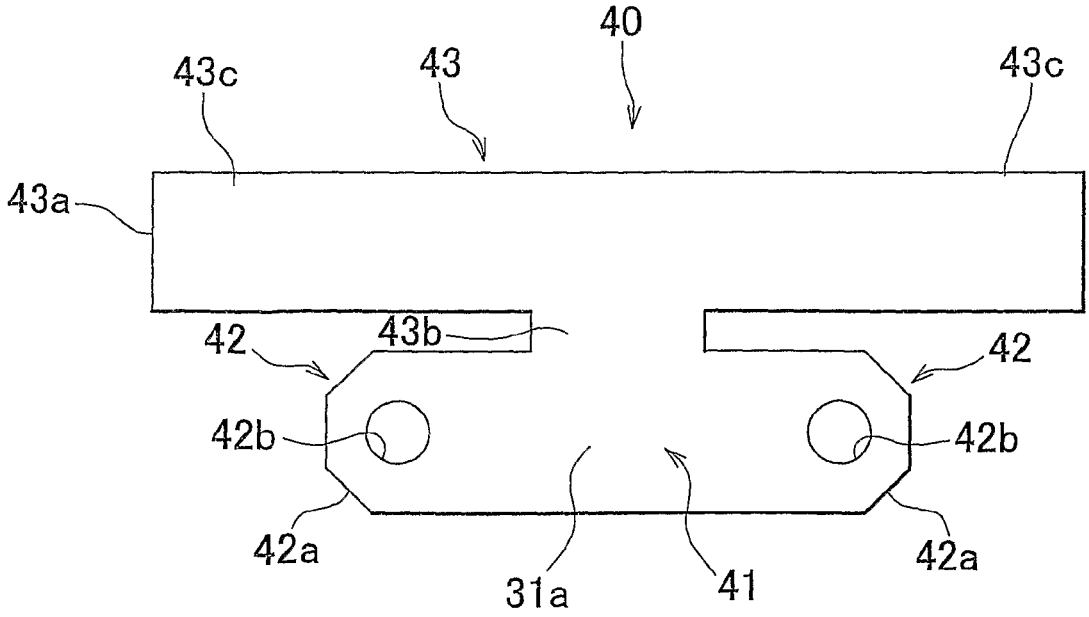
Figure 8:
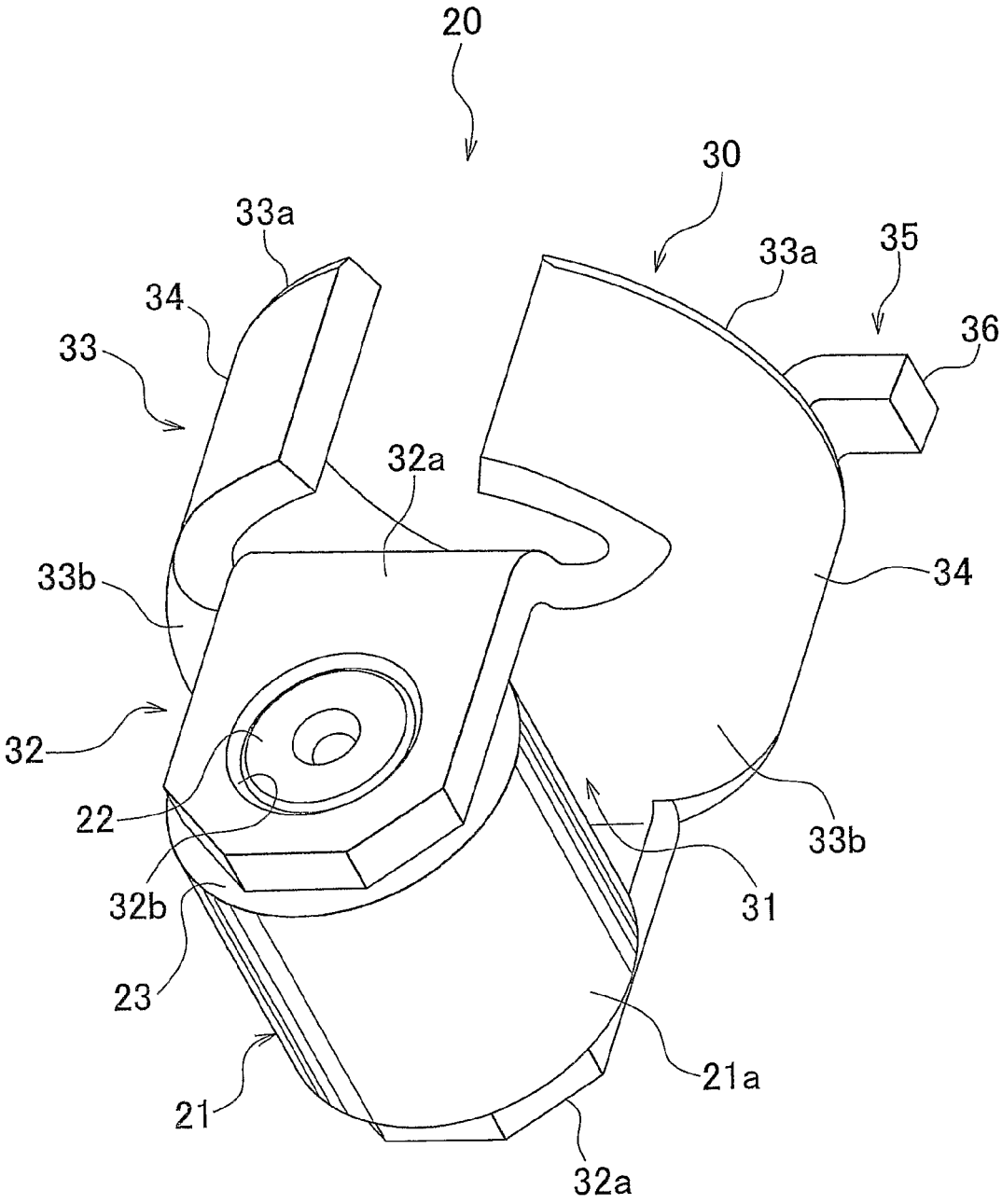
FIG. 8 is a perspective view of a roller lifter as claimed in a second embodiment of the invention.
Figure 9:
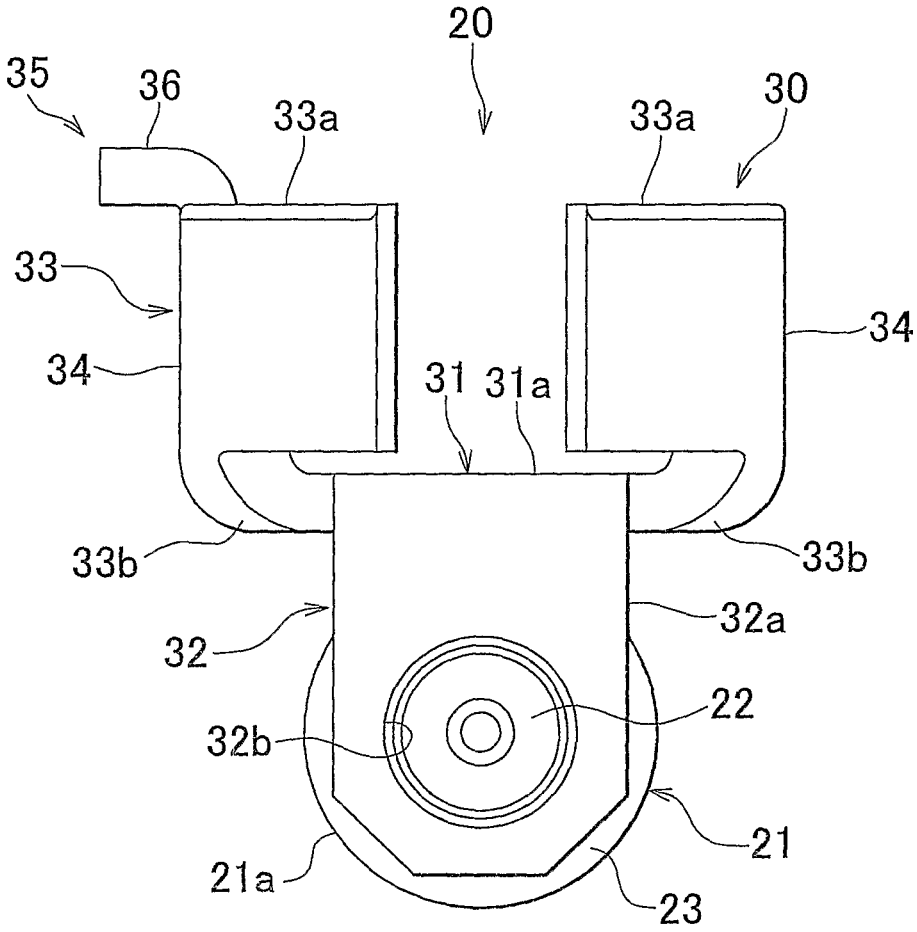
FIG. 9 is a side view of a roller lifter as claimed in the second embodiment.
Figure 10:
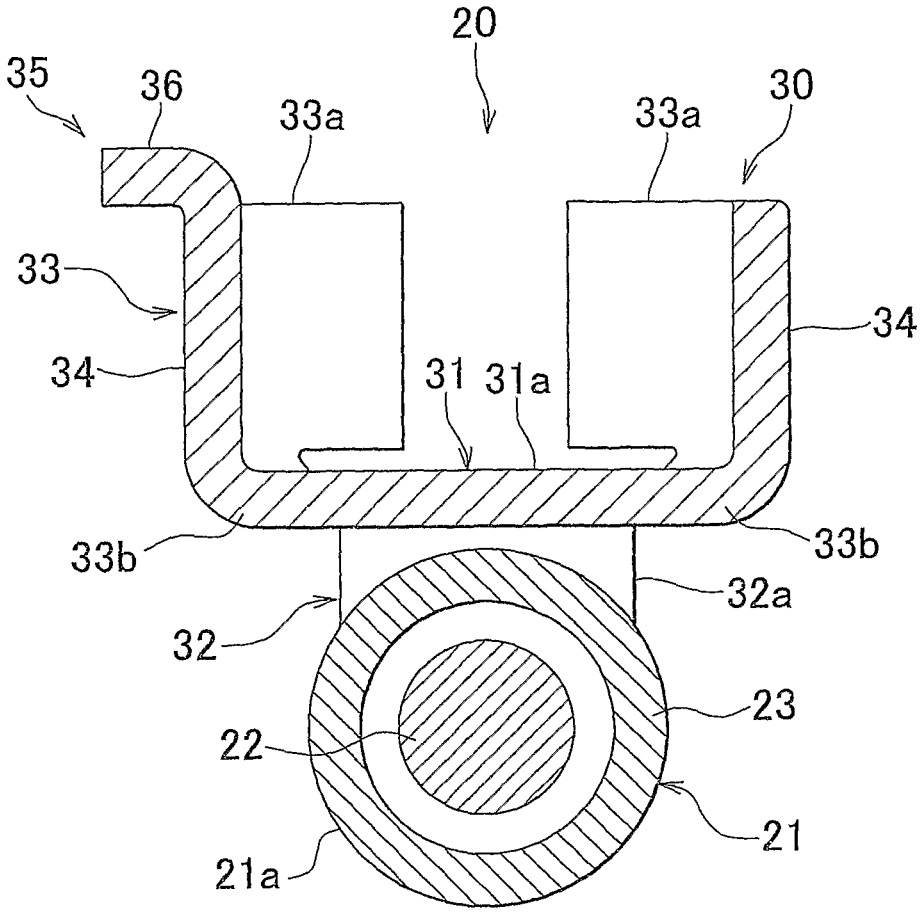
FIG. 10 is a side cross-sectional view of a roller lifter as claimed in the second embodiment.

Namely, as shown in FIGS. 7A and 7B, in the case the third portion 43 is a portion that protrudes in only one direction from the first portion 41 (upward direction in FIGS. 7A and 7B), the strip-like portion 43*a* of the third portion 43 has a portion that is extended in the lengthwise direction (horizontal direction in FIGS. 7A and 7B) in the form of an extending portion 43*c*. The curved portion 33*a* of the guide portion 33 in the base 30 is formed by the strip-like portion 43*a* possessing this extending portion 43*c*. In other words, in this case, the curved portion 33*a* is formed by curving a single strip-like portion 43*a*. Consequently, a length required for forming the curved portion 33*a* is secured for the length in the lengthwise direction of a single strip-like portion 43*a* including the extending portion 43*c*.

FIG. 7A shows the case of the strip-like portion 43*a* being extended in the direction towards one side (right side in FIG. 7A) in the lengthwise direction, or in other words, the case of having the extending portion 43*c* on one side in the lengthwise direction. In addition, FIG. 7B shows the case of the strip-like portion 43*a* being extended in the directions of both sides (left and right sides in FIG. 7B) in the lengthwise direction, or in other words, the case of having the extending portion 43*c* on both sides in the lengthwise direction. In this manner, the third portion 43 in the plate-shaped material 40 is a portion that protrudes on at least one direction in a direction that intersects the protruding direction of the second portion 42 from the first portion 41.

According to the roller lifter 20 and the production method of the roller lifter 20 as described above, portions having a prescribed shape such as the roller holding portion 32 of the roller lifter 20 provided with a rotatably supported roller 21 can be formed by sheet metal forming such as press forming from an integral material in the form of the plate-shaped material 40, thereby making it possible to considerably produce the number of production steps and costs while also easily realizing a compact and lightweight structure.

Namely, in the roller lifter 20 of the first embodiment, portions having a prescribed shape such as the roller holding portion 32 and the guide portion 33 are formed by forming the integral plate-shaped material 40 by sheet metal forming such as press forming for the portion of the body 30 that supports the roller 21. In other words, the body 30 is formed to nearly a final target shape (finished product shape) by sheet metal forming such as press forming only. Consequently, the number of machining steps can be reduced considerably thereby resulting in an accompanying significant reduction in costs.

In addition, since the body 30 is formed by sheet metal forming from the integral plate-shaped material 40, there is less likelihood of surplus material remaining on the body 30, thereby making it possible to achieve a compact structure and light weight. Consequently, the roller lifter 20 can easily be made compact and lightweight.

Figure 29:
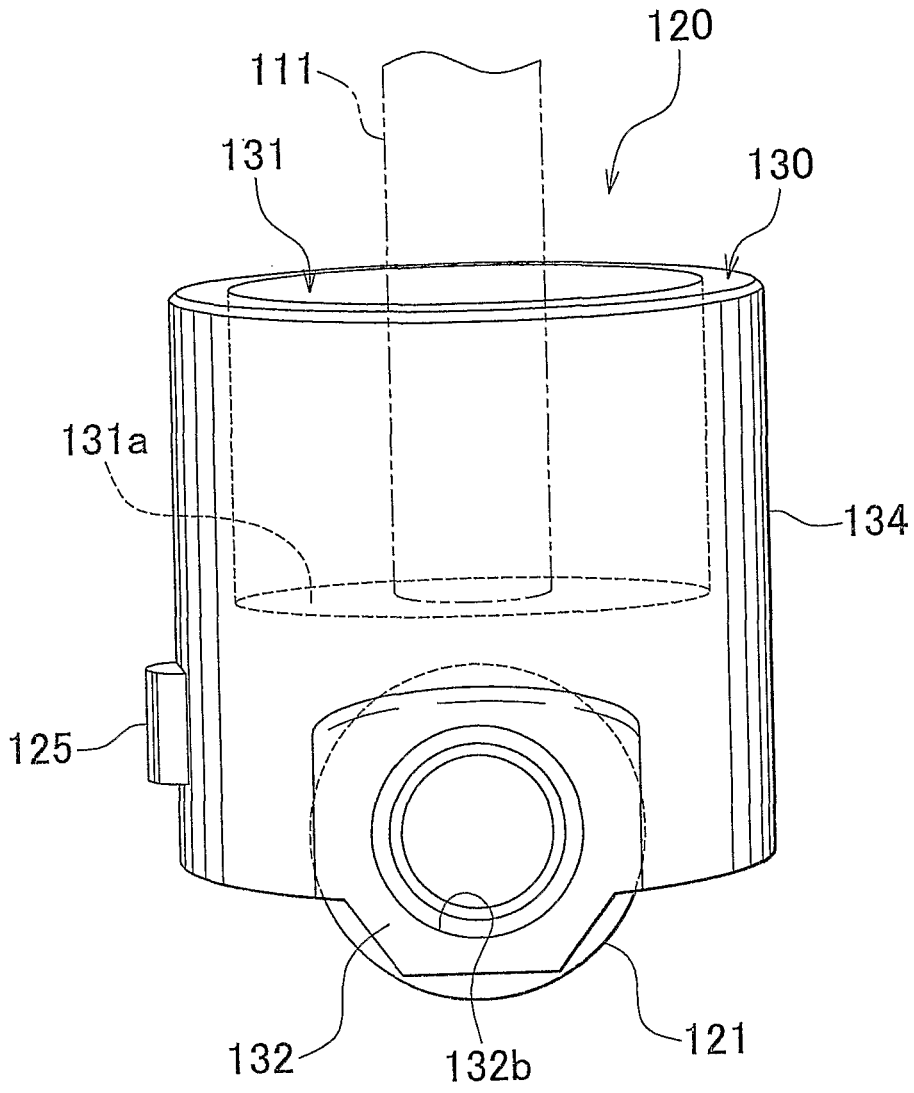
FIG. 29 is a drawing showing an example of the configuration of a roller lifter of the related art.

The following provides an explanation of effects brought about by the roller lifter 20 of the first embodiment in comparison with the related art. FIG. 29 shows a roller lifter as an example of a roller lifter 120 of the related art. In the roller lifter 120 as claimed in this example, the portion of a body 130 thereof is produced by cold forging. In other words, the body 130 is formed by forming a rod-shaped (cylindrical) material by cold forging followed by machining to a prescribed shape.

More specifically, as shown in FIG. 29, the body 130 has portions having a prescribed shape such as a roller holding portion 132 that holds a roller 121 with supporting holes 132*b*, a plunger contact portion 131 that forms a plunger contact surface 131*a* contacted by a plunger 111, and a guide surface 134 that guides reciprocating motion of the roller lifter 120. Each of these portions having a prescribed shape is formed by carrying out machining such as grinding or drilling on a material formed by cold forging.

Consequently, when producing the roller lifter 120, numerous machining steps are required to form portions having a prescribed shape such as the roller holding portion 132 required in the body 130. Namely, since there limitations on the shapes that can be formed by cold forging, cold forging only enables parts to be formed to a shape that is far removed from a final target shape (finished product shape), and numerous machining steps are required after cold forging.

In addition, in the roller lifter 120 as claimed in this example, a rotation stopper pin 125 is used as a rotation stopper in the form of a separate member from the members that compose the body 130. The rotation stopper pin 125 forms a projecting portion in the guide surface 134 by being press-fit into the guide surface 134 of the body 130. The projecting portion formed by this rotation stopper pin 125 fits into a groove and the like formed in the inner peripheral surface of a member in which the roller lifter 120 is contained (refer to the above-mentioned lifter guide 18). In other words, the roller lifter 120 is subjected to an action that stops rotation by the projecting portion formed by the rotation stopper pin 125 that engages from the inside with the member in which the roller lifter 120 is contained.

According to this rotation stopper, it is necessary to produce the rotation stopper pin 125 as a separate member from the members that compose the body 130 as well as a machining step for forming a portion having a shape (such as press-fitting hole) that corresponds to the rotation stopper pin 125 in the body 130.

In this manner, in the related art as demonstrated by the roller lifter 120 claimed in this example, since numerous machining steps are required, the number of production steps increase resulting in an accompanying increase in costs. With respect to this point, according to the roller lifter 20 of the first embodiment, since portions having a prescribed shape such as the roller holding portion 32 in the body 30 are formed by sheet metal forming such as press forming, and since machining of the body 30 (such as drilling) is not required for composing a rotation stopper, additional machining following sheet metal forming is not required. Consequently, both the number of production steps and costs can be reduced considerably.

The following provides an explanation of other embodiments of the roller lifter 20. Furthermore, in each of the embodiments explained below, the same reference numerals are used for the sake of convenience to indicate those portions that are in common with the portions of the first embodiment, and explanations thereof are omitted.

The following provides an explanation of a second embodiment of the roller lifter 20. In the roller lifter 20 of the second embodiment, a rotation stopper 35 is provided in the body 30 as shown in FIGS. 8 to 11. The rotation stopper 35 is a plate-shaped portion that protrudes towards the outside in the radial direction of the cylindrical surface shape (to be simply referred to as the "outside in the radial direction") with respect to the guide portion 33. The roller lifter 20 of the second embodiment has an upper protruding piece 36, which protrudes from the upper end of one of the curved portions 33*a* that compose the guide portion 33, as the rotation stopper 35.

Figure 11:
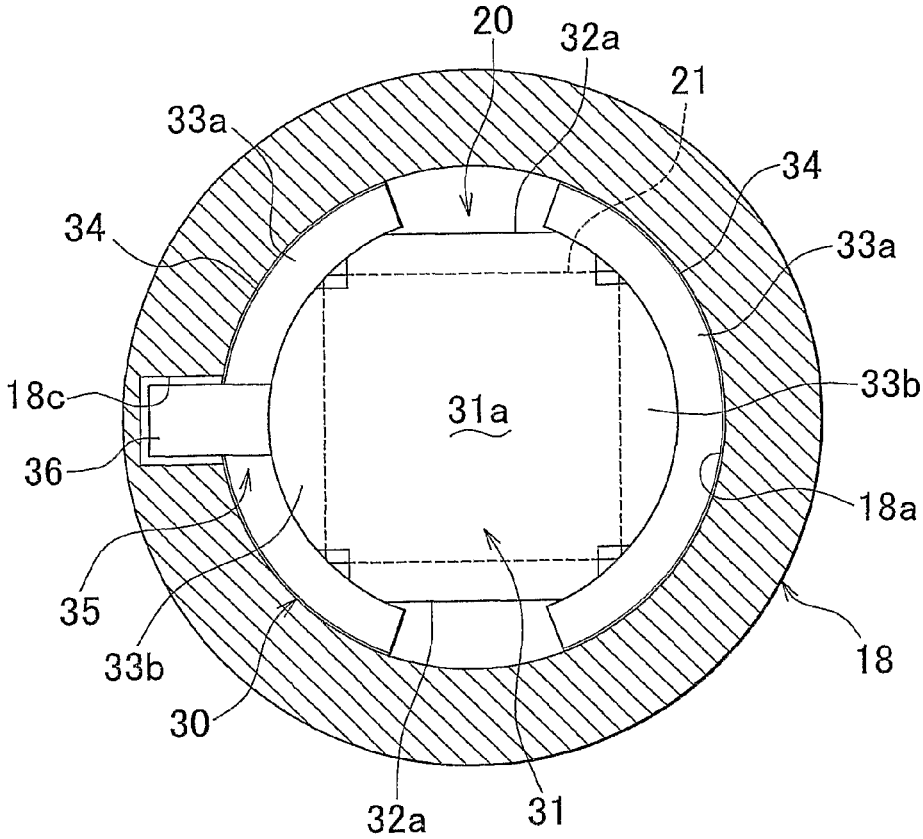
FIG. 11 is an overhead partial cross-sectional view showing the configuration of a rotation stopper of a roller lifter as claimed in the second embodiment.

Namely, as shown in FIG. 11, the upper protruding piece 36 serving as the rotation stopper 35 is a portion that protrudes towards the outside in the radial direction (left side in FIG. 11) and protrudes to the outside in the radial direction farther than one of the guide surfaces 34. In other words, the rotation stopper 35 is a portion that protrudes farther to the outside in the radial direction than one of the guide surfaces 34 in the roller lifter 20. The upper protruding piece 36 is a portion that is formed by bending a protruding portion formed at the top of one of the curved portions 33*a* towards the outside in the radial direction.

In addition, the rotation stopper 35 prevents rotation relative to the lifter guide 18 of the body 30 (the previously described relative rotation), having for the direction of the axis of rotation thereof the coaxial direction with respect to the guide member 33 (direction perpendicular to the plate surface of the base portion 31 (vertical direction)), by engaging with the lifter guide 18. Here, the lifter guide 18 functions as a guide member having a contact surface with the guide surfaces 34 in the form of the inner peripheral surface 18*a*. In other words, the body 30 is movably contained within the lifter guide 18.

More specifically, as shown in FIG. 11, a groove 18*c*, in which is fit the upper protruding piece 36, is formed in the inner peripheral surface 18*a* of the lifter guide 18 in the state in which the roller lifter 20 (body 30) is contained within the lifter guide 18. The groove 18*c* is formed in the coaxial direction of the lifter guide 18 (vertical direction in FIG. 1) in the inner peripheral surface 18*a* of the lifter guide 18. The groove 18*c* at least has a length that allows reciprocating motion of the roller lifter 20 (length in the vertical direction). The groove 18*c* has a slight gap in the direction of width in its relationship with the rotation stopper 35. In other words, the upper protruding piece 36 in the state of being fit in the groove 18*c* has a slight gap in the direction of width with respect to the groove 18*c*. The groove 18*c* is formed at a prescribed accuracy by grinding using an end mill to match the shape and size of the upper protruding piece 36.

In the roller lifter 20 of the second embodiment, the rotation stopper 35 is provided in the form of a portion that is formed by bending at the end in the direction of the other plate surface (upward direction) in the plate-shaped portion that composes the guide portion 33. Namely, the rotation stopper 35 in the form of the upper protruding piece 36 is provided as a portion that is formed by bending at the upper edge that is the upper end of one of the curved portions 33*a* serving as plate-shaped portions that compose the guide portion 33. Furthermore, in the second embodiment, although the rotation stopper 35 is provided at one location in the body 30, it may also be provided at a plurality of locations. In the case a plurality of the rotation stoppers 35 are provided, the plurality of rotation stoppers 35 are provided at prescribed intervals in the circumferential direction of the body 30.

Figure 12:
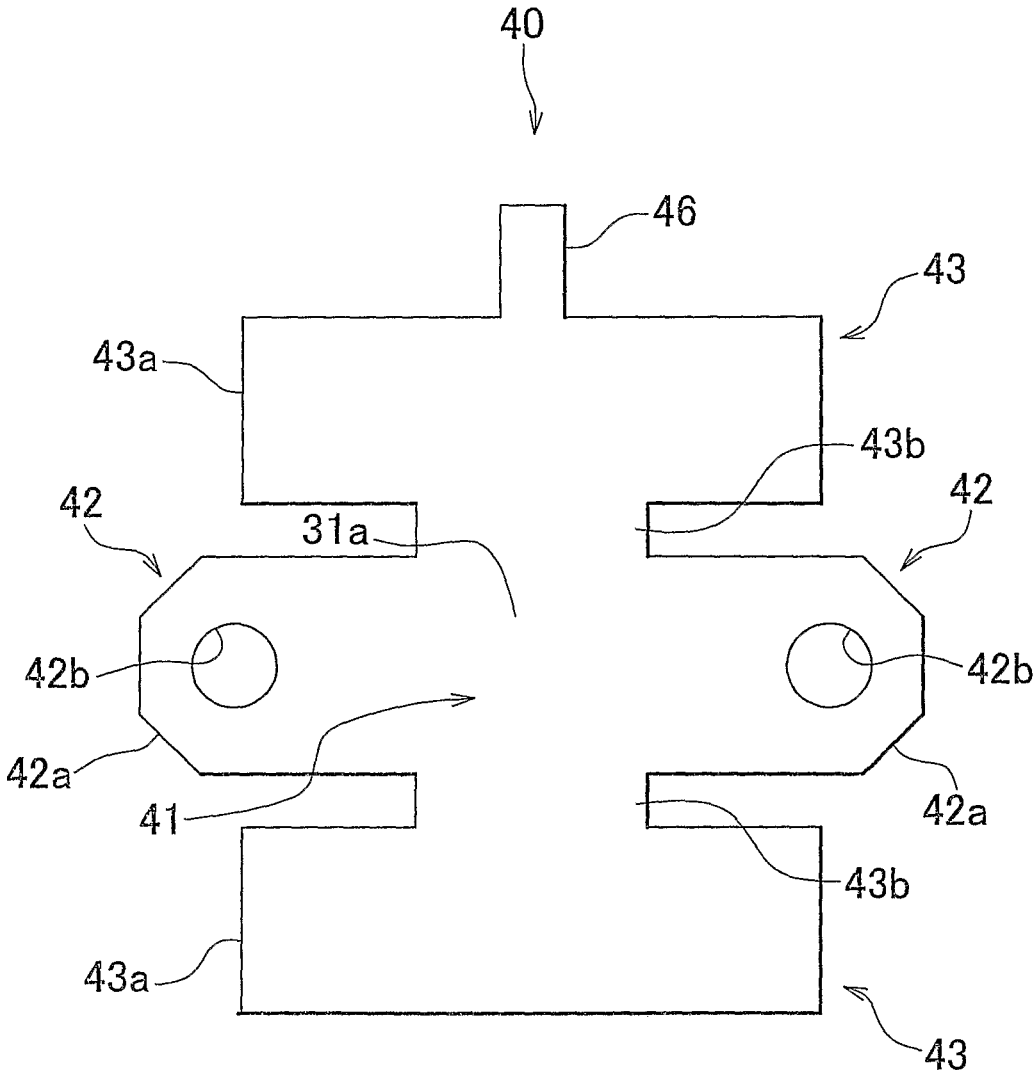
FIG. 12 is a drawing showing a plate-shaped material as claimed in a second embodiment of the invention.

In the second embodiment, with respect to the production method of the roller lifter 20, the plate-shaped material 40 prepared in the material preparation step has a portion that forms the rotation stopper 35. More specifically, as shown in FIG. 12, the plate-shaped material 40 in the second embodiment has a portion that forms the rotation stopper 35 in the form of a protruding piece 46. In other words, a portion having a shape corresponding to the protruding piece 46 is formed in the plate-shaped material 40 produced by, for example, stamping out from sheet metal as previously described.

The protruding piece 46 is provided on the strip-like portion 43*a* of one of the third portions 43 (upper side in FIG. 12). The protruding piece 46 is formed as a portion having a roughly rectangular shape that protrudes in the direction that the third portion 43 protrudes from the first portion 41 at a prescribed position in the lengthwise direction thereof (horizontal direction in FIG. 12).

In the second forming step as previously described, the upper protruding piece 36 is formed in the form of the rotation stopper 35 in the body 30 by curving one of the strip-like pieces 43*a*, which forms the one of the curved portions 33*a* of the guide member 33, together with bending the protruding piece 46 to the outside in the radial direction. Bending of the protruding piece 46 to form the rotation stopper 35 in this manner is carried out in the second forming step by sheet metal forming such as press forming for forming the guide portion 33. In other words, the step for forming the rotation stopper 35 is included in the second forming step. However, the step for forming the rotation stopper 35 may also be a separate step from the first forming step for forming the plate-shaped material 40 and the second forming step.

According to the roller lifter 20 and the production method of the roller lifter 20 of the second embodiment, the number of production steps and costs can be further reduced. Namely, since a rotation stopper can be integrally formed, a separate member such as the rotation stopper pin 24 (see FIG. 5) for composing a rotation stopper is not required in comparison with the case of the first embodiment, thereby making it possible to reduce the number of production steps and costs. In addition, since the rotation stopper is provided on the side of the roller lifter 20, it is no longer necessary to provide a rotation stopper such as a rotation stopper on the side of the roller lifter 18, thereby making it possible to also reduce the cost of the lifter guide 18.

Moreover, processing for composing the rotation stopper can be easily carried out with greater accuracy in comparison with the case of the first embodiment. In other words, in the second embodiment, processing for forming the groove 18*c* with respect to the upper protruding piece 36 can be carried out with comparatively greater accuracy than processing for forming the insertion hole 18*b* for the rotation stopper bar 24 in the case of the first embodiment.

Figure 13:
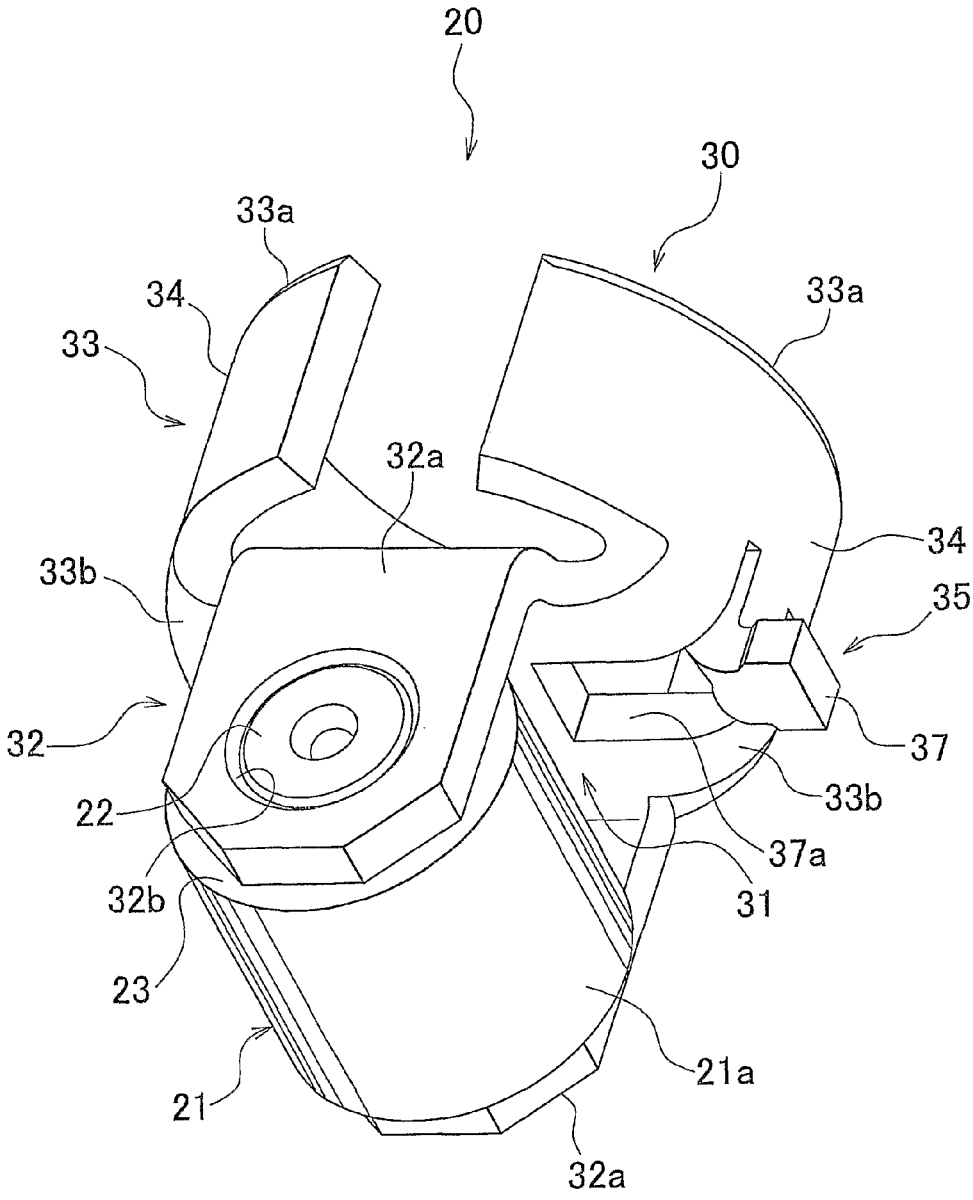
FIG. 13 is a perspective view of a roller lifter as claimed in a third embodiment of the invention.
Figure 14:
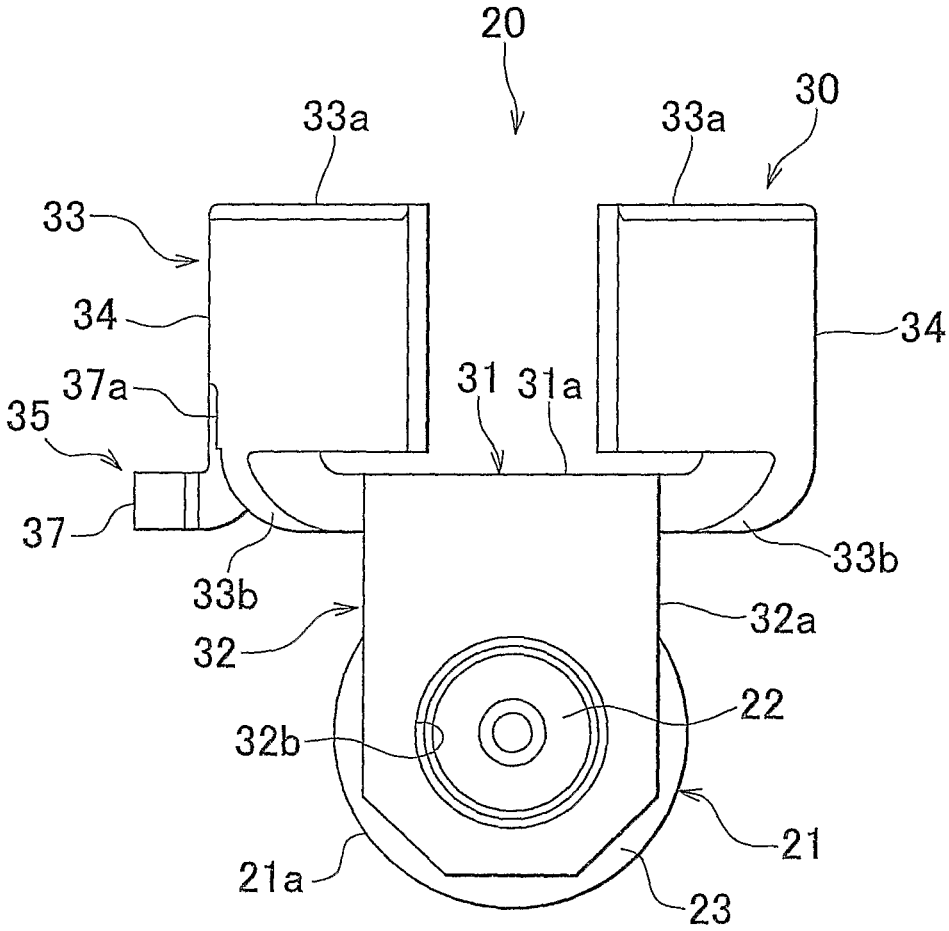
FIG. 14 is a side view of a roller lifter as claimed in the third embodiment.
Figure 15:
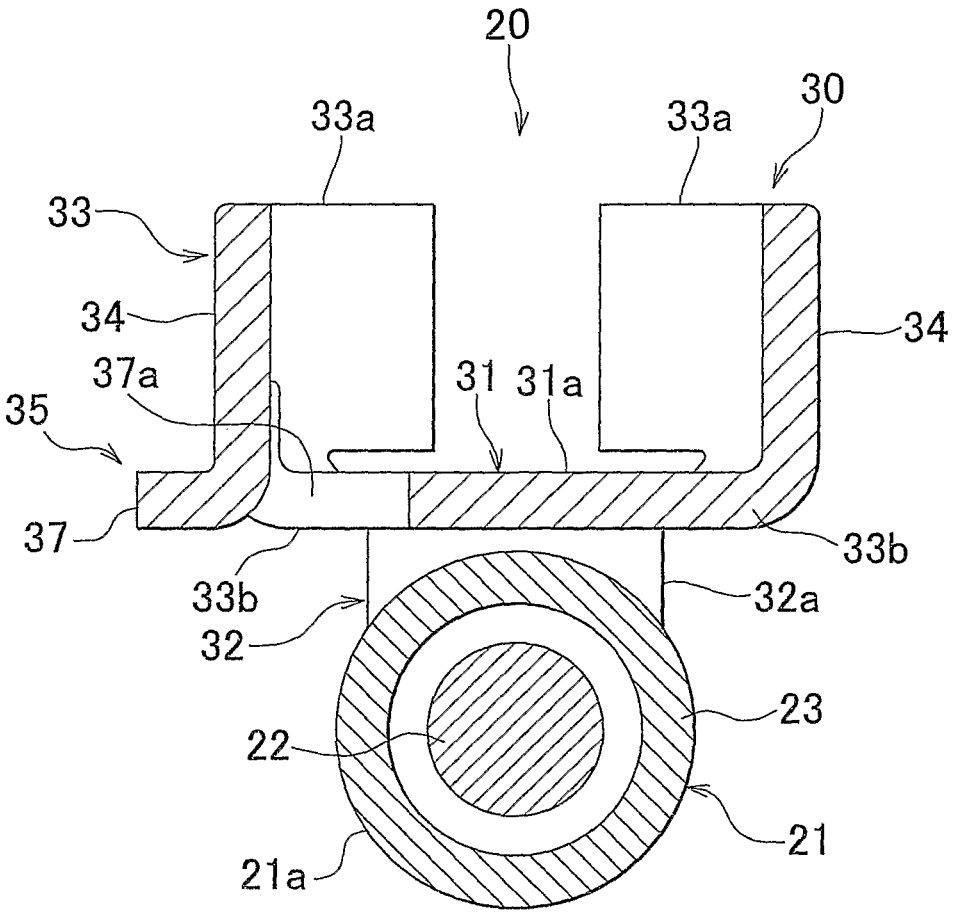
FIG. 15 is a side cross-sectional view of a roller lifter as claimed in the third embodiment.

The following provides an explanation of a third embodiment of the roller lifter 20. As shown in FIGS. 13 to 15, in the roller lifter 20 of the third embodiment, the rotation stopper 35 possessed by the body 30 is provided in the form of a portion that is bent at the end in the direction of one of the plate surfaces (downward direction) in the plate-shaped portion that composes the guide portion 33. In other words, the roller lifter 20 of the third embodiment has the rotation stopper 35 in the form of a lower protruding piece 37 that protrudes from the lower end of one of the curved portions 33*a* in the form of plate-shaped portions that compose the guide portion 33.

The lower protruding piece 37 is formed by cutting out a portion of the body 30 extending from the base portion 31 to one of the curved portions 33*a* through one of the coupling portions 33*b* of the guide member 33 (base of the guide portion 33 with respect to the base portion 31) together with bending to the outside in the radial direction. In other words, the rotation stopper 35 in the form of the lower protruding piece 37 is provided in the form of a portion that is cut out from the base of the guide portion 33 relative to the base portion 31 and then bent to the outside in the radial direction. Thus, a notch 37*a* is present in a portion extending from the base portion 31 to one of the curved portions 33*a* through one of the coupling portions 33*b* in the form of a portion where the lower protruding piece 37 has been cut out.

The lower protruding piece 37 is formed in the form of a portion in which the base side thereof is connected to the portion of one of the curved portions 33*a* in the body 30. In the third embodiment, the lower protruding piece 37 has a shape such that the distal end thereof becomes wider as shown in the drawings. However, there are no particular limitations on the shape of the lower protruding piece 37 provided it allows the strength of the body 30 to be secured in the roller lifter 20 at the base portion 31 and the guide portion 33 in the state in which the lower protruding piece 37 is formed (state in which the notch 37*a* is present). The lower protruding piece 37 formed in this manner is fit into the groove 18*c* of the lifter guide 18 (see FIG. 11) in the of the rotation stopper 35.

Figure 16:
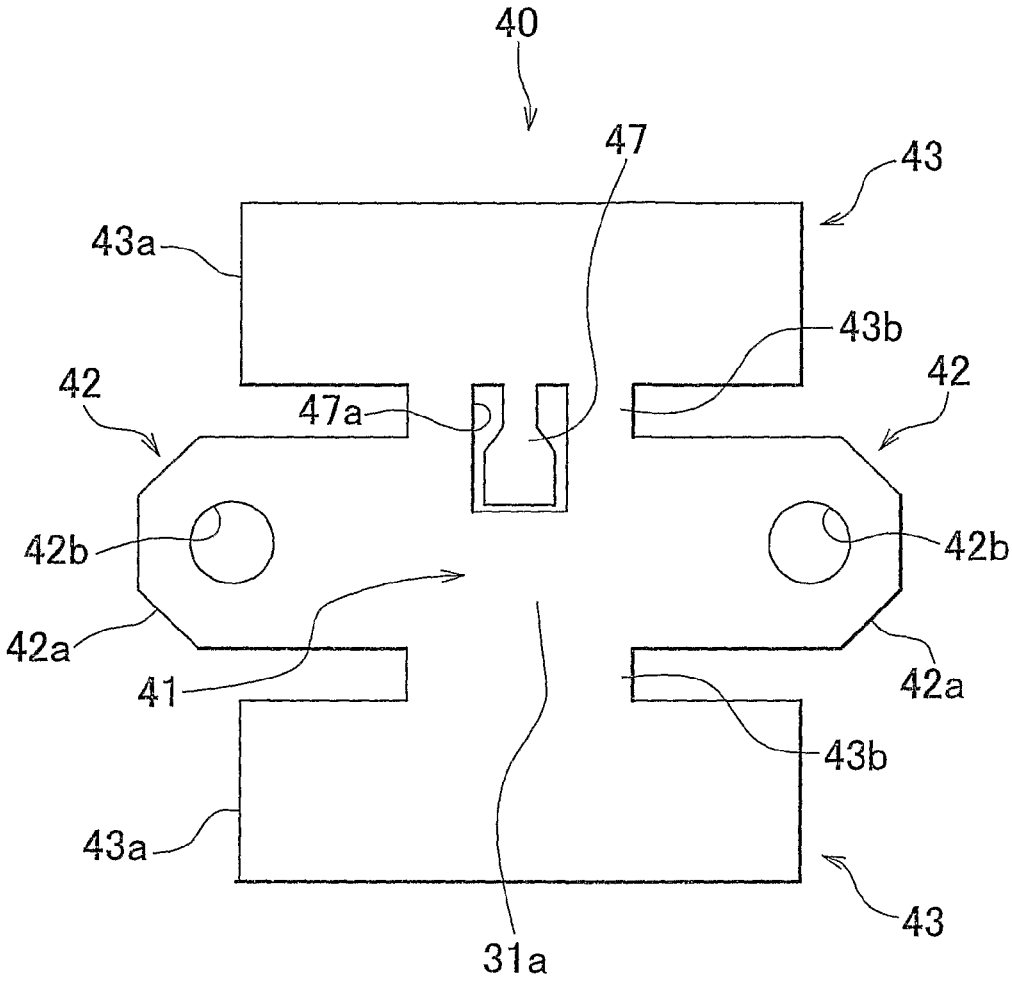
FIG. 16 is a drawing showing a plate-shaped material as claimed in a third embodiment of the invention.

As shown in FIG. 16, the plate-shaped material 40 in the third embodiment has a stamped out piece 47 for the portion that forms the rotation stopper 35. The stamped out piece 47 is a piece formed by a stamped out portion 47*a* in a portion extending from the first portion 41 to one of the strip-like portions 43*a* through one of the connecting portions 43*b* in one of the third portions 43. The stamped out piece 47 is foamed in the form of a portion connected to the portion of one of the strip-like portions 43*a* in the plate-shaped material 40. The lower protruding piece 37 is formed by bending this type of stamped out piece 47 to the outside in the radial direction by sheet metal forming such as press forming.

According to the roller lifter 20 of the third embodiment, the rotation stopper 35 can be provided without increasing the length of the body 30 in the vertical direction in comparison with the second embodiment. In other words, since the rotation stopper 35 in the third embodiment is positioned at an intermediate portion of the body 30 in the vertical direction (portion between the upper end of the body 30 (lower end of the guide portion 33) and the lower end of the body 30 (lower end of the roller holding portion 32)), there is no effect on the length of the body 30 in the vertical direction. In other words, the length of the body 30 in the vertical direction can be shortened by an amount resulting from the absence of the upper protruding piece 36 on the upper end of the body 30 as in the second embodiment.

Since the length of the body 30 in the vertical direction can be shortened, the entire roller lifter 20 can be reduced in size. As a result, the size of the high-pressure fuel pump 1 can also be reduced, making it possible to lower the installation height of the high-pressure fuel pump 1 in an engine. In addition, since the rotation stopper 35 does not affect the length of the body 30 in the vertical direction, the length in the vertical direction of the guide surfaces 34 formed by the guide portion 33 in the body 30 can conversely can easily be increased. The guideability of the roller lifter 20 by the guide surfaces 34 is improved by increasing the length in the vertical direction of the guide surfaces 34.

Furthermore, the upper protruding piece 36 of the second embodiment may also be provided for the rotation stopper 35 in addition to the lower protruding piece 37. In other words, in the case of providing a plurality of rotation stoppers 35 as previously described, together with providing the upper protruding piece 36 at the upper end of one of the curved portions 33*a* of the guide portion 33, the lower protruding piece 37 may be provided at the lower end of the same curved portion 33*a*. In other words, the rotation stopper 35 is provided in the form of a portion formed by at least bending at the end in the direction of one of the plate surfaces (lower direction) and the direction of the other plate surface (upper direction) in one of the plate-shaped portions (curved portions 33*a*) that compose the guide portion 33.

Figure 17:
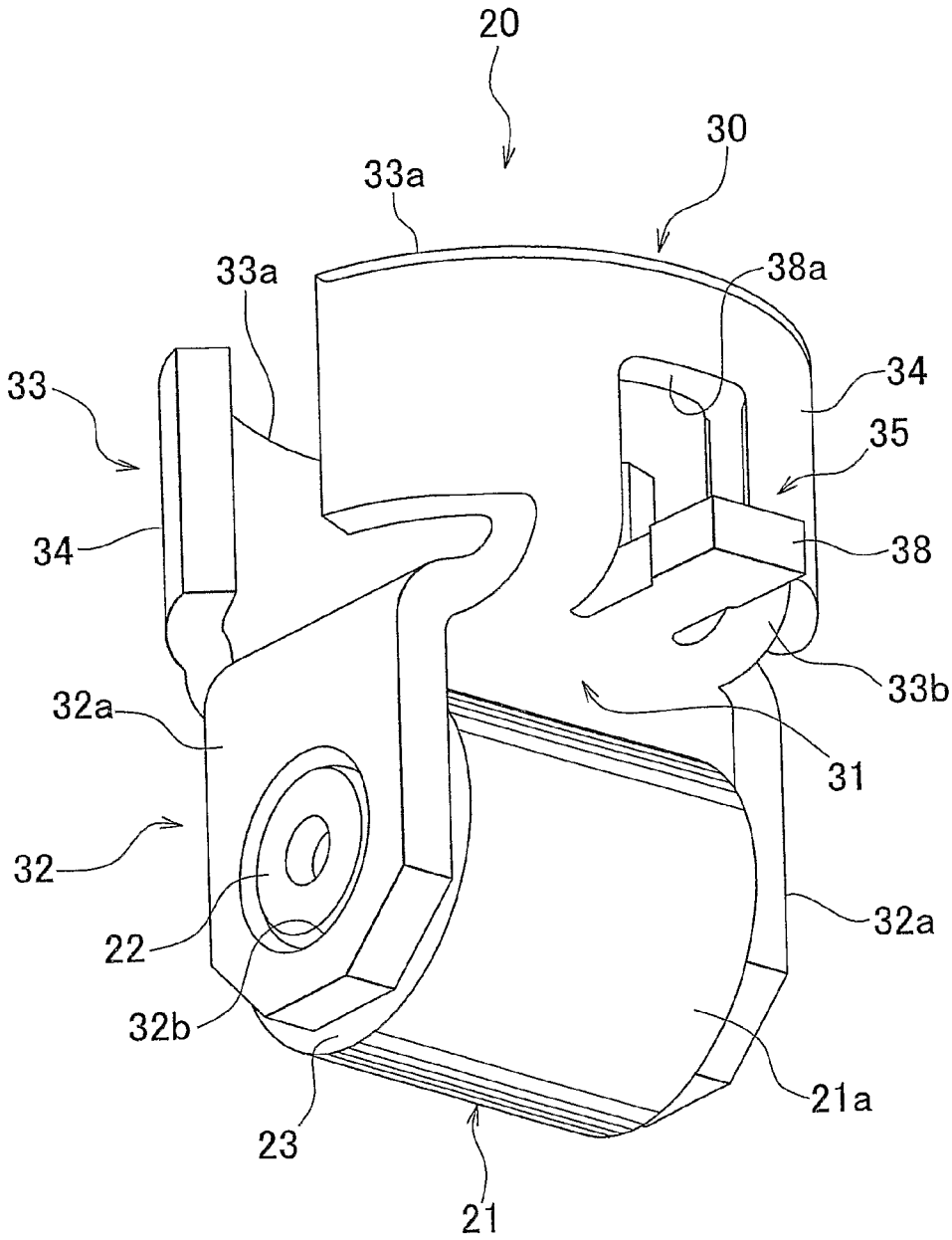
FIG. 17 is a perspective view of a roller lifter as claimed in a fourth embodiment of the invention.
Figure 18:
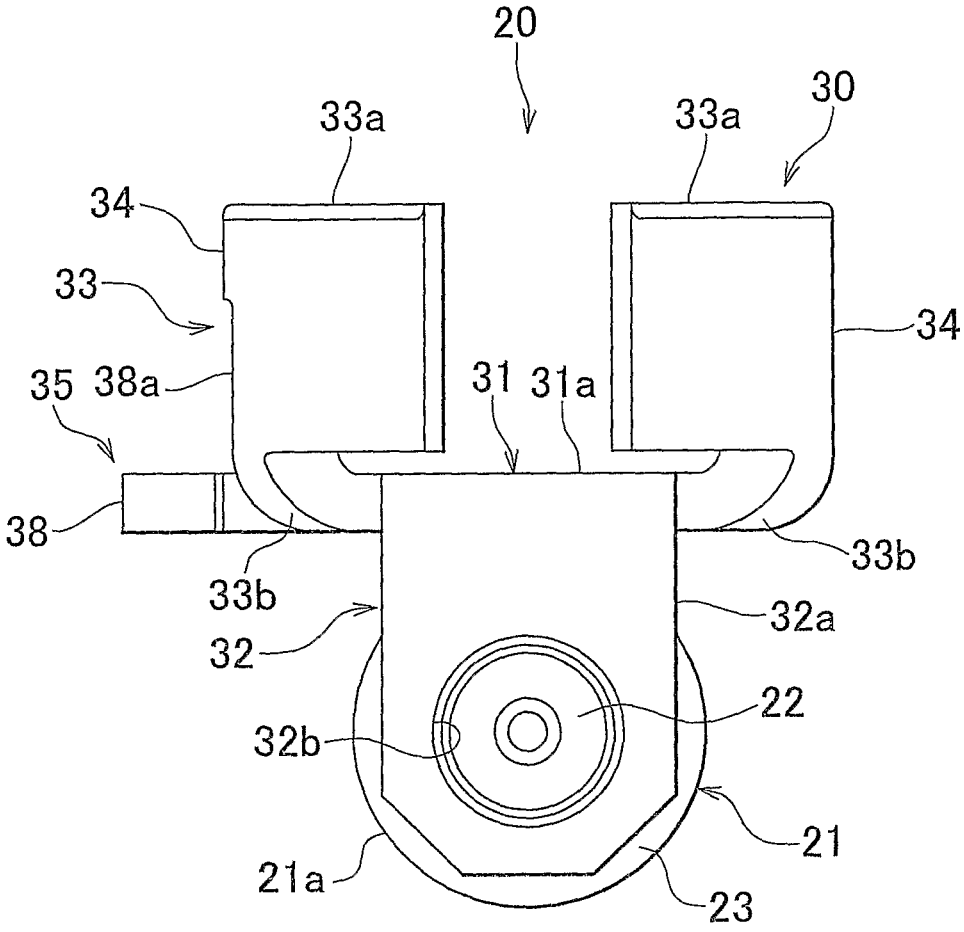
FIG. 18 is a side view of a roller lifter as claimed in the fourth embodiment.
Figure 19:
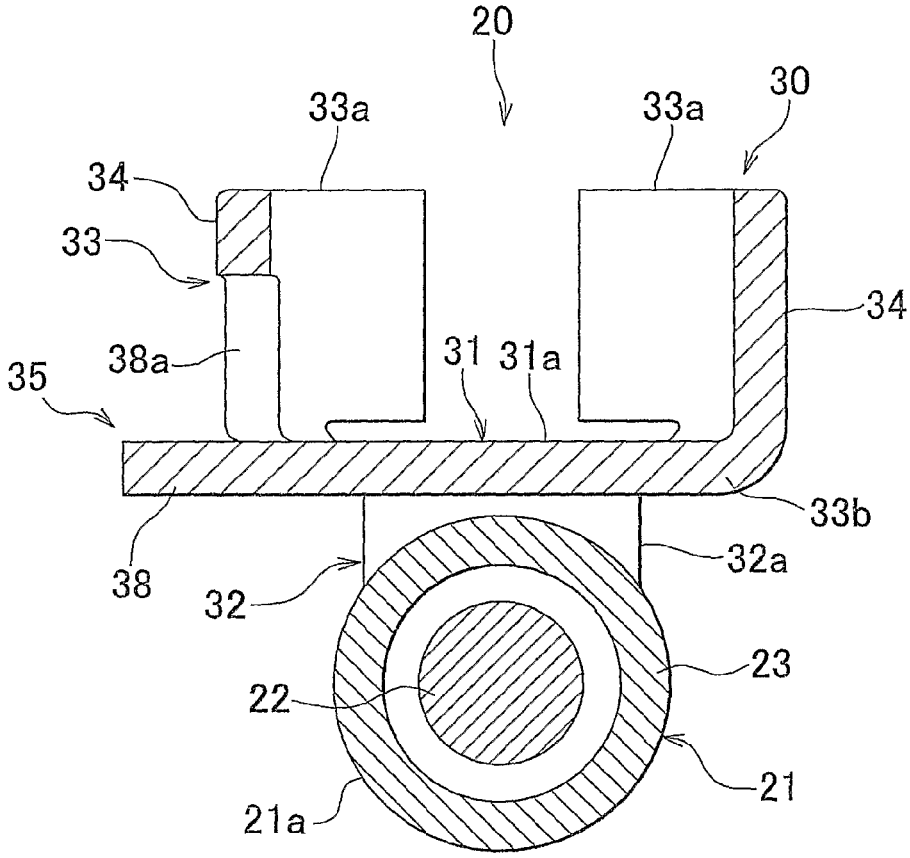
FIG. 19 is a side cross-sectional view of a roller lifter as claimed in the fourth embodiment.

The following provides an explanation of a fourth embodiment of the roller lifter 20. As shown in FIGS. 17 to 19, in the roller lifter 20 of the fourth embodiment, the rotation stopper 35 possessed by the body 30 is in common with the rotation stopper 35 of the third embodiment (lower protruding piece 37). The rotation stopper 35 of the fourth embodiment differs from the third embodiment in that the rotation stopper 35 is provided in the form of a portion that extends from the base portion 31. In other words, the roller lifter 20 of the fourth embodiment has the rotation stopper 35 in the form of an extending piece 38 that protrudes from the base portion 31 to the outside in the radial direction.

The extending piece 38 is formed in the form of a portion in which a portion of one of the curved portions 33*a* and the coupling portions 33*b* is cut out from the guide portion 33. In other words, the rotation stopper 35 in the form of the extending piece 38 is provided in the form of a portion that is cut out at a portion of one of the curved portions 33*a* and coupling portions 33*b* together with being bent to the outside in the radial direction. Thus, a notch 38*a* is present in the portion of one of the curved portions 33*a* and coupling portions 33*b* in the form of a portion where the extending piece 38 has been cut out.

The extending piece 38 is formed in the form of a portion in which the base side (side opposite from the distal end protruding to the outside in the radial direction) is connected to the portion of the base portion 31 in the body 30. In the fourth embodiment, the extending piece 38 has a shape such that the distal end thereof becomes wider as shown in the drawings. However, there are no particular limitations on the shape of the extending piece 38 provided it allows the strength of the body 30 to be secured in the roller lifter 20 at the guide portion 33 in the state in which the extending piece 38 is formed (state in which the notch 38*a* is present). The extending piece 38 formed in this manner is fit into the groove 18*c* of the lifter guide 18 (see FIG. 11) in the form of the rotation stopper 35.

Figure 20:
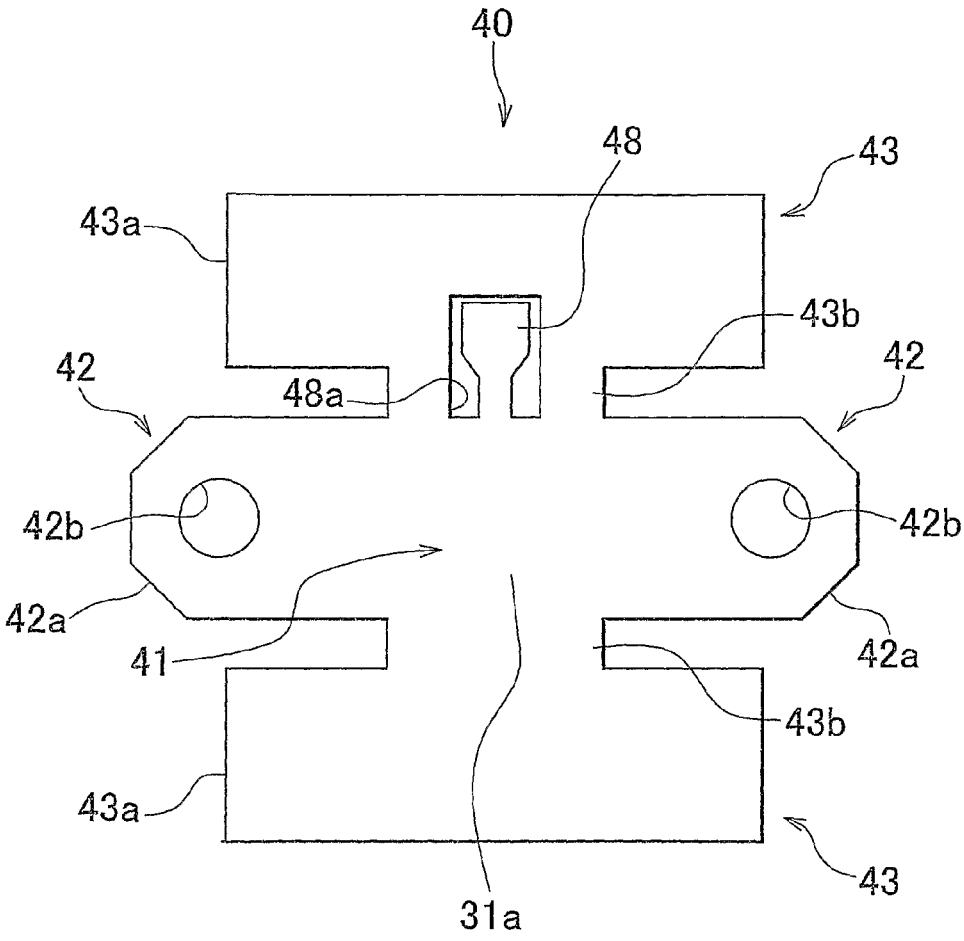
FIG. 20 is a drawing showing a plate-shaped material as claimed in a fourth embodiment of the invention.

As shown in FIG. 20, the plate-shaped material 40 in the fourth embodiment has a stamped out piece 48 in the form of a portion that forms the rotation stopper 35. The stamped out piece 48 is a piece that is formed by a stamped out portion 48*a* in the portion of the strip-like portion 43*a* and the connecting portion 43*b* in one of the third portions 43. The stamped out piece 48 is formed as a portion that is connected to the portion of the first portion 41 in the plate-shaped material 40. With respect to the plate-shaped material 40 in which the stamped out piece 48 is present in this manner, when one of the third portions 43 that compose the guide portion 33 is formed, the extending piece 38 is formed by the stamped out piece 48 by allowing the stamped out piece 48 to remain as a portion extending from the first portion 41 (without bending).

The same effects as the third embodiment are obtained by the roller lifter 20 of the fourth embodiment. Furthermore, although the rotation stopper 35 is provided in the form of the extending piece 38 as a portion that extends from the base portion 31 by cutting out a portion of one of the third portions 43 that compose the guide portion 33, the rotation member is not limited thereto. In other words, the rotation stopper 35 may also be provided by cutting out a portion of the second portion 42 that composes the roller holding portion 32.

Figure 21:
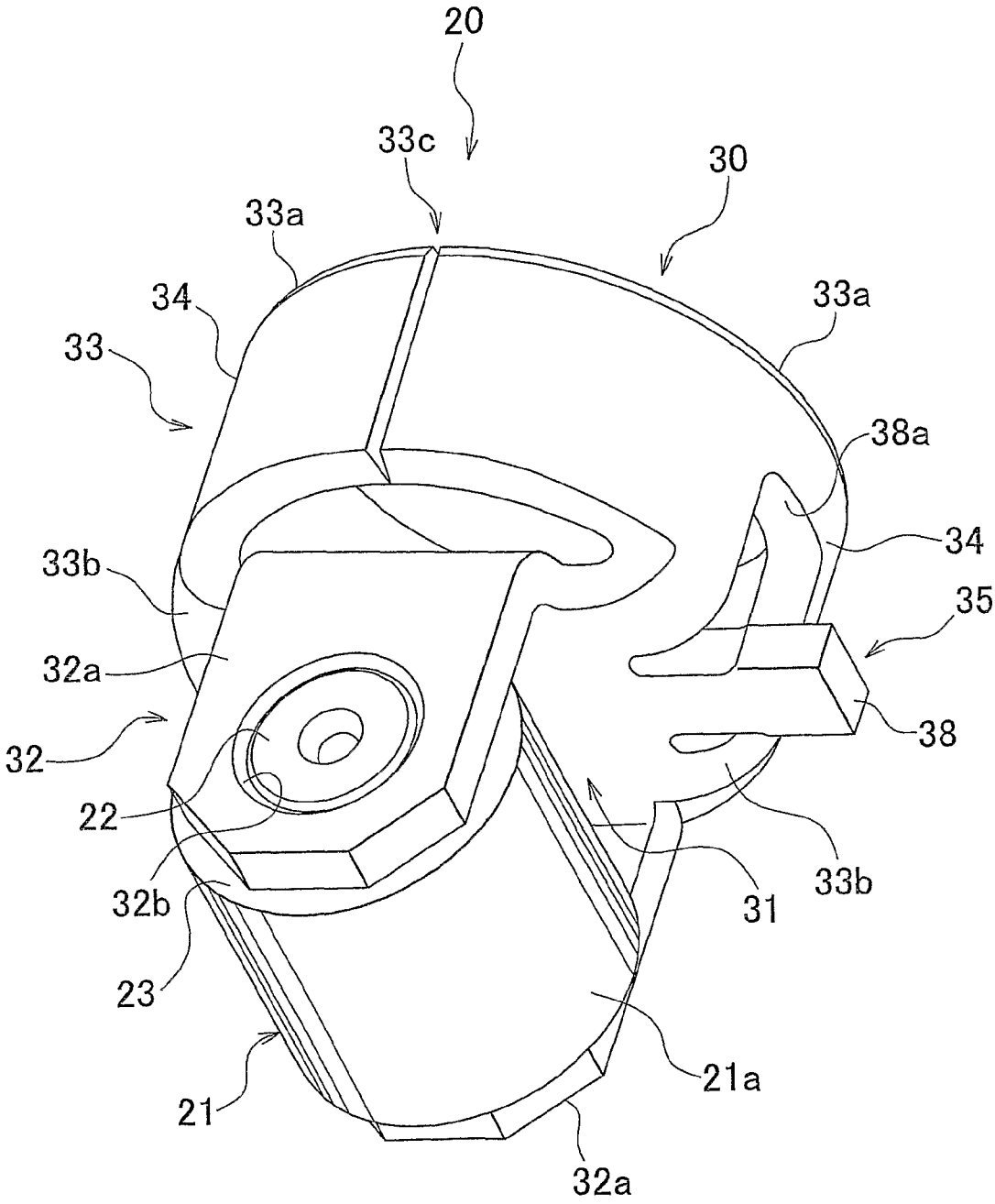
FIG. 21 is a perspective view of a roller lifter as claimed in a fifth embodiment of the invention.
Figure 22:
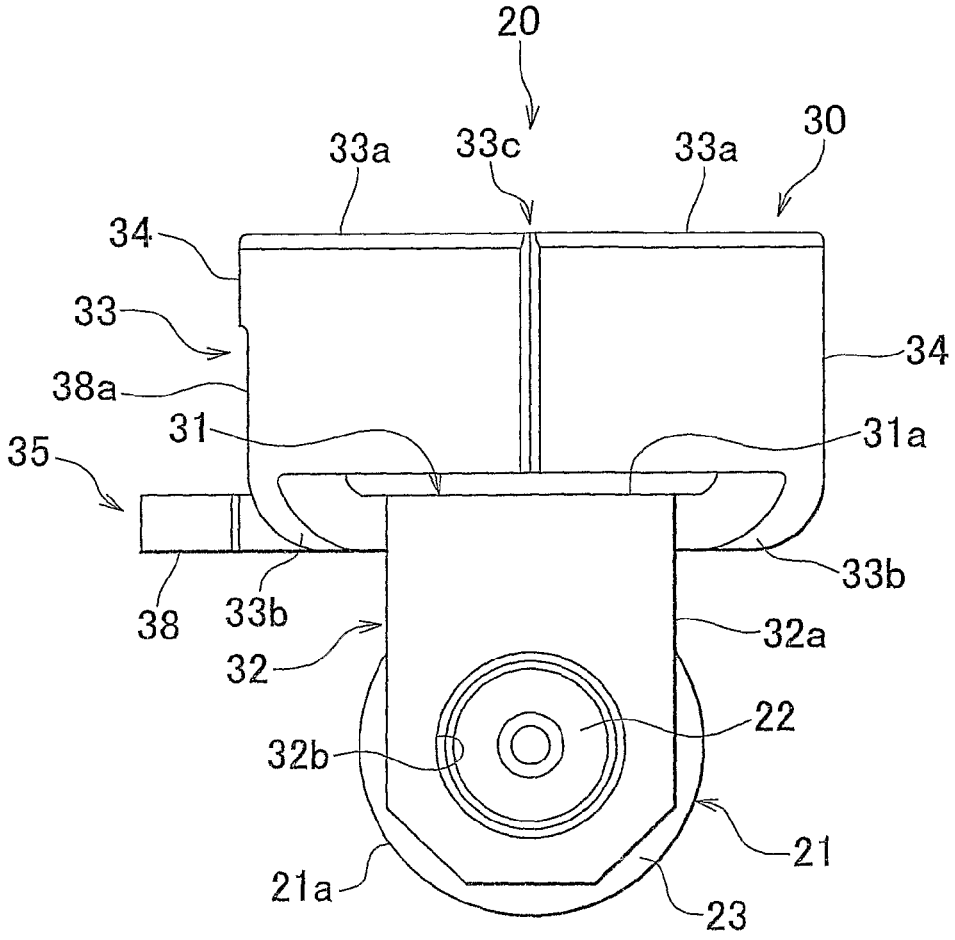
FIG. 22 is a side view of a roller lifter as claimed in the fifth embodiment.
Figure 23:
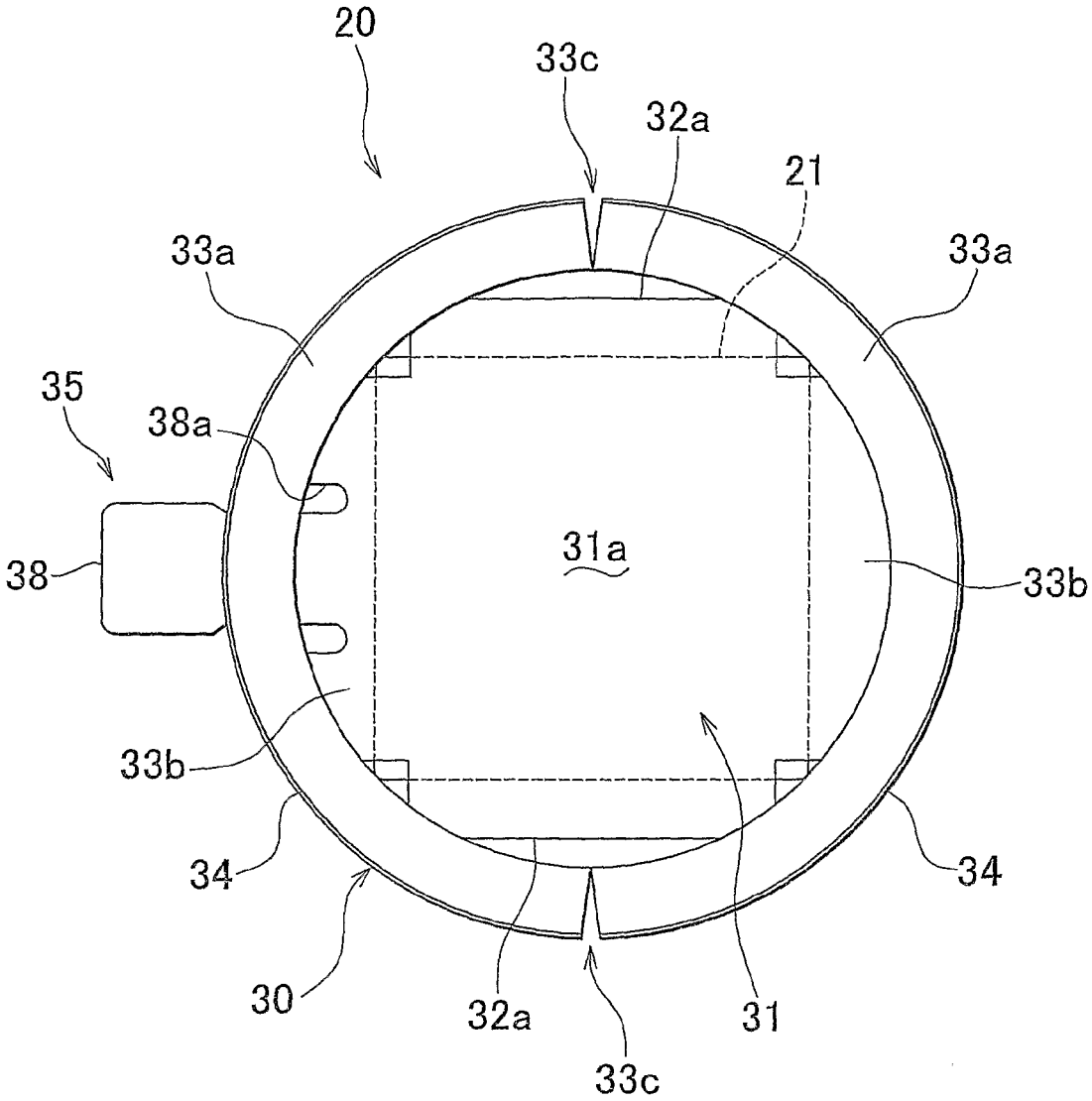
FIG. 23 is an overhead view of a roller lifter as claimed in the fifth embodiment.

The following provides an explanation of a fifth embodiment of the roller lifter 20. As shown in FIGS. 21 to 23, in the roller lifter 20 of the fifth embodiment, the ends of plate-shaped portions in the circumferential direction that compose the guide portion 33 are in contact with respect to the cylindrical shape surface. In other words, contacting portions 33*c* are provided in a state in which the ends of the pair of opposing curved portions 33*a* are in contact by extending the curved portions 33*a* serving as plate-shaped portions that compose the guide portion 33 in the circumferential direction.

Thus, in the roller lifter 20 of the fifth embodiment, in comparison with the roller lifter 20 of the first embodiment, for example, the portion of the gap C3 (see FIG. 5) between the ends in the circumferential direction with respect to the cylindrical shape surface between the opposing curved portions 33*a* is closed by the ends of the curved portions 33*a* in the circumferential direction. More specifically, as shown in the drawings, the contacting portions 33*c* are in a state in which the inner peripheral surfaces of the curved portions 33*a* are in contact between the ends of the pair of curved portions 33*a*. In other words, in the contacting portions 33*c*, an approximately V-shape is formed when viewed from overhead in FIG. 23 by end surfaces of the curved portions 33*a* making mutual contact. However, the ends of the curved portions 33*a* may also make contact over their entire surfaces in the contacting portions 33*c*.

In addition, the contacting portions 33*c* between the opposing curved portions 33*a* are provided by extending each curved portion 33*a* to both sides in the circumferential direction by roughly the same length each, and are present at positions opposing the opposing direction of the pair of supporting plates 32*a* (direction of the axis of rotation of the roller 21) (see FIG. 23). In this manner, the portions of the curved portions 33*a* in the guide member 33 are portions having a roughly cylindrical shape as a result of the ends of the curved portions 33*a* making contact. Accompanying this, the guide surfaces 34 formed by the guide portion 33 also roughly cylindrical surfaces. Furthermore, the body 30 in the fifth embodiment has the extending portion 38 in the same manner as the fourth embodiment.

Figure 24:
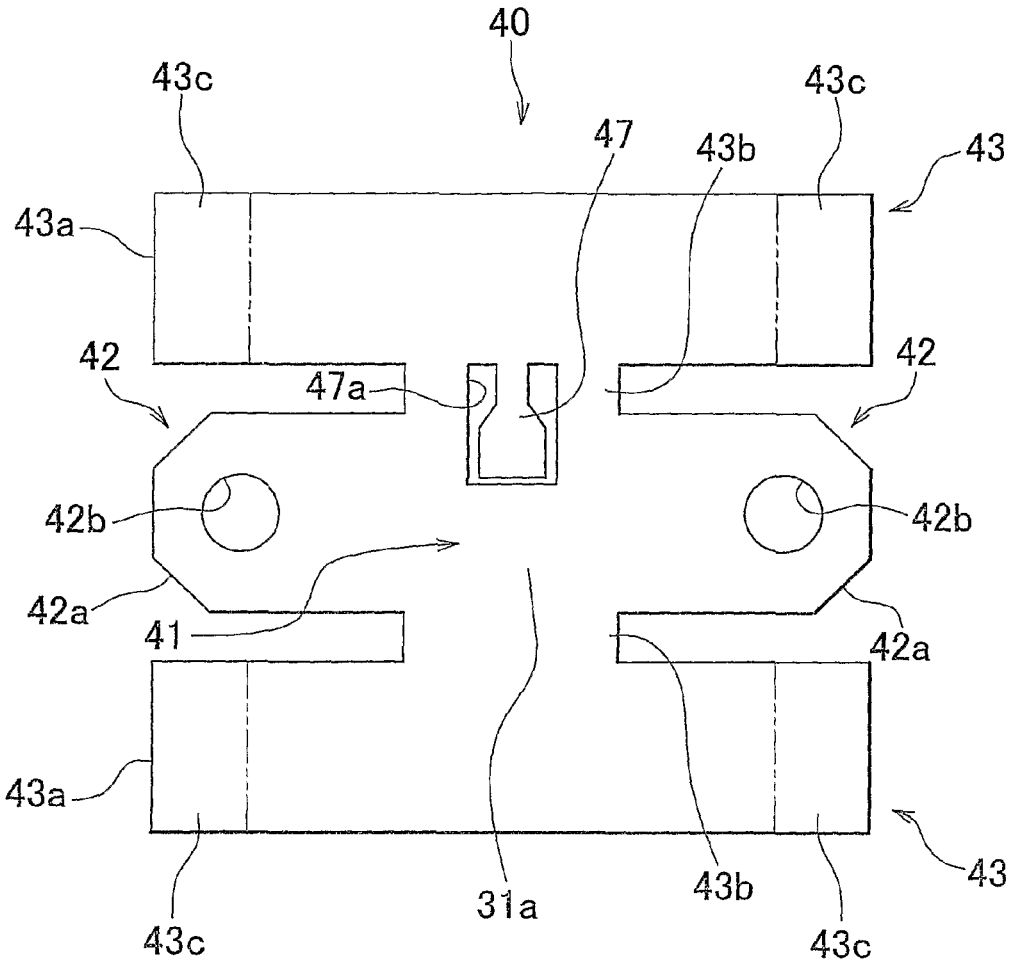
FIG. 24 is a drawing showing a plate-shaped material as claimed in a fifth embodiment of the invention.

As shown in FIG. 24, the plate-shaped material 40 of the fifth embodiment has extending portions 43*c* in the form of portions for forming the contacting portions 33*c*. The extending portions 43*c* are portions that form both ends in the lengthwise direction (horizontal direction in FIG. 24) of the curved portions 43*a* of the third portions 43. In other words, the extending portions 43*c* are portions formed by extending the strip-like portions 43*a* towards both sides in the lengthwise direction from a length in the case of the plate-shaped material 40 of the first embodiment (see the double-dot broken lines), for example, with respect to the lengthwise direction of the strip-like portions 43*a*. The curved portions 33*a* in a state in which the ends thereof in the circumferential direction are in contact, namely the contacting portions 33*c*, are formed by curving the strip-like portions 43*a* having the extending portions 43*c* in this manner in the above-mentioned second forming step.

Furthermore, in the fifth embodiment, although the extending portions 43*c* are provided on both sides in the lengthwise direction of the strip-like portions 43*a* for each of the pair of strip-like portions 43*a*, the extending portions 43*c* are not limited thereto. In other words, the extending portions 43*c* may be provided only on one side in the lengthwise direction of the strip-like portions 43*a*, or may be provided only on one of the strip-like portions 43*a* among the pair of strip-like portions 43*a*.

In addition, although the ends of the curved portions 33*a* are in contact over the entire vertical direction at the contacting portions 33*c* in the fifth embodiment (the extending portions 43*c* are formed by extending the entire strip-like portions 43*a* in the direction of width (vertical direction in FIG. 24) in the plate-shaped material 40), the ends of the curved portions 33*a* are not limited thereto. In other words, the positions where the ends of the curved portions 33*a* make contact at the contacting portions 33*c* may also be a portion of the vertical direction. In this case, in the plate-shaped material 40, the extending portions 43*c* are formed by only partially extending the strip-like portions 43*a* in the direction of width.

According to the roller lifter 20 of the fifth embodiment, rigidity of the guide portion 33 is enhanced since the pair of curved portions 33*a* that compose the guide portion 33 are mutually supported through the contacting portions 33*c*. Processability of the body 30 (such as grindability of grinding carried out in the form of finishing on the guide surfaces 34) is improved by enhancing the rigidity of the guide portion 33. In addition, the withstand load of the body 30 is improved as a result of enhancing the rigidity of the guide portion 33. More specifically, withstand load is improved with respect to, for example, a load like that of the guide surfaces 34 being pressed against the inner peripheral surface 18*a* of the lifter guide 18 that is received by the body 30 through the roller 21 accompanying rotation of the cam 12.

Figure 25:
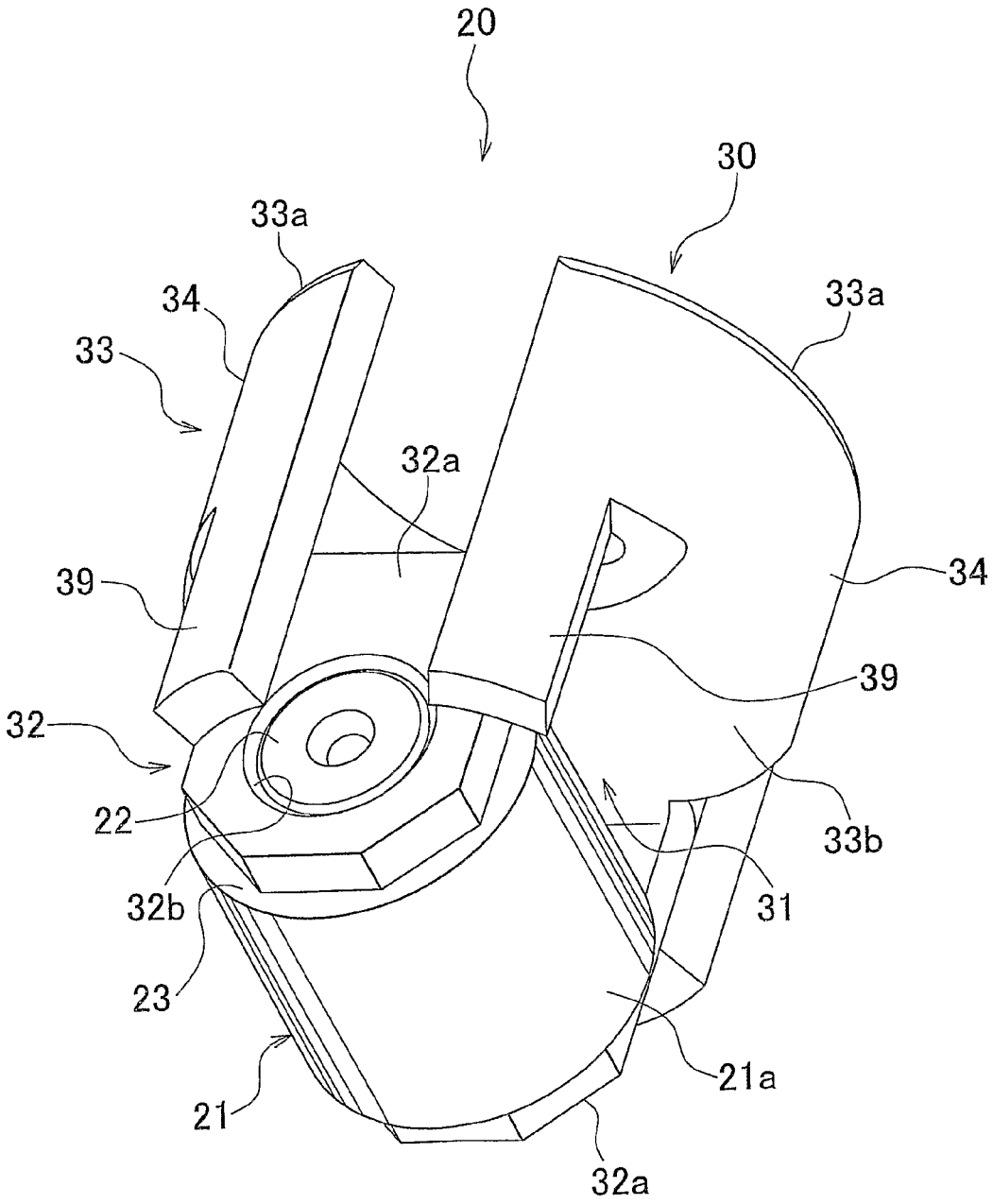
FIG. 25 is a perspective view of a roller lifter as claimed in a sixth embodiment of the invention.
Figure 26:
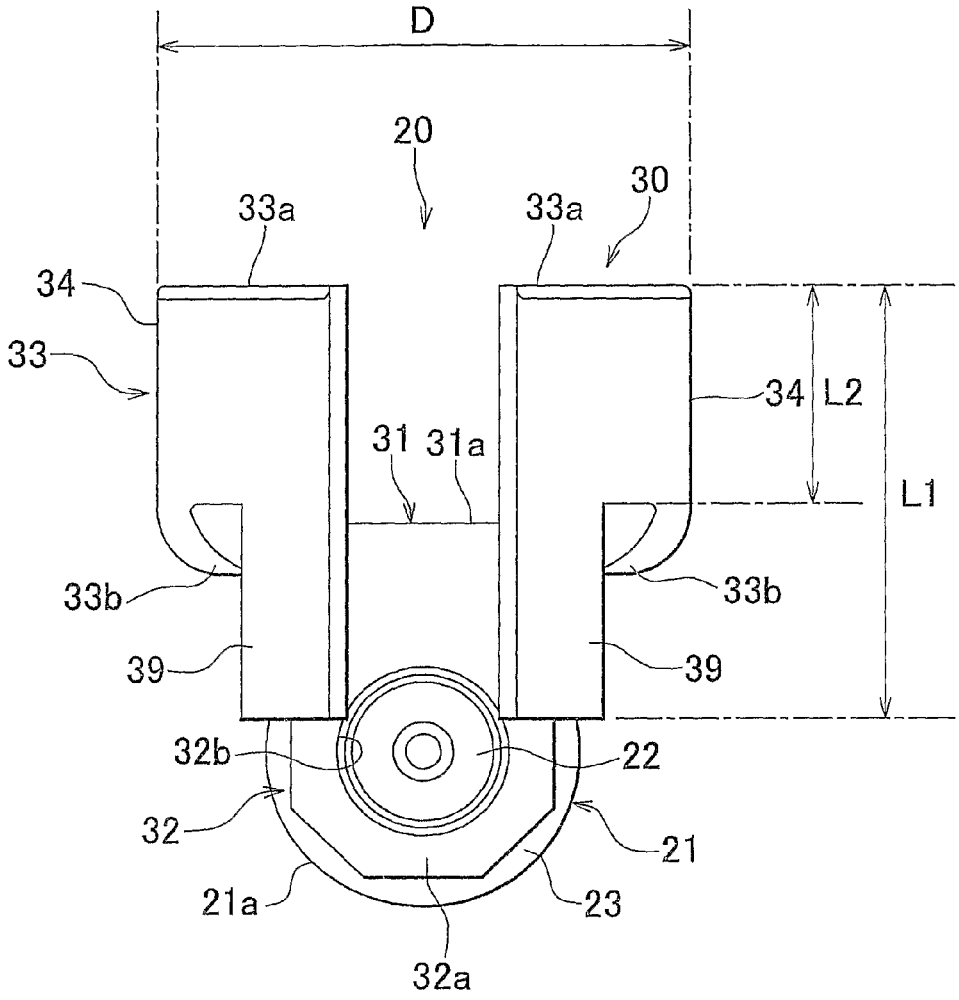
FIG. 26 is a side view of a roller lifter as claimed in the sixth embodiment.

The following provides an explanation of a sixth embodiment of the roller lifter 20. As shown in FIGS. 25 and 26, in the roller lifter 20 of the sixth embodiment, the guide portion 33 has extending portions 39 that extend the guide surfaces 34. The extending portions 39 are portions that are extended in the direction of one of the plate surfaces (downward direction) from the plate-shaped portion that composes the guide portion 33, and which also similarly extend the guide surfaces 34 downward.

The extending portions 39 are plate-shaped portions that are formed by protruding downward from the curved portions 33*a* serving as plate-shaped portions that compose the guide portion 33. The outer surfaces of the extending portions 39 serve as surfaces that form portions of the guide surfaces 34. In other words, the extending portions 39 form surface portions connecting to the outer peripheral surfaces of the curved portions 33*a* that form the guide surfaces 34, and extend the guide surfaces 34 downward. The extending portions 39 are respectively provided on both ends in the circumferential direction on each of the pair of curved portions 33*a*. Thus, the extending portions 39 are portions that form the above-mentioned gap C3 (see FIG. 5) together with the curved portions 33*a*.

The curved portions 39 are provided at locations that do not interfere with the roller holding portion 32 or the roller 21 by protruding downward from the curved portions 33*a*. As shown, for example, in the drawings of the sixth embodiment, the extending portions 39 have a length roughly equal to the width of the curved portions 33*a* (length in the vertical direction). In other words, the extending portions 39 of the sixth embodiment partially extend by roughly twice the width of the guide surfaces 34 (length in the vertical direction) downward, and this partially extends the width of the curved portions 33*a* downward by roughly twice that width.

Figure 27:
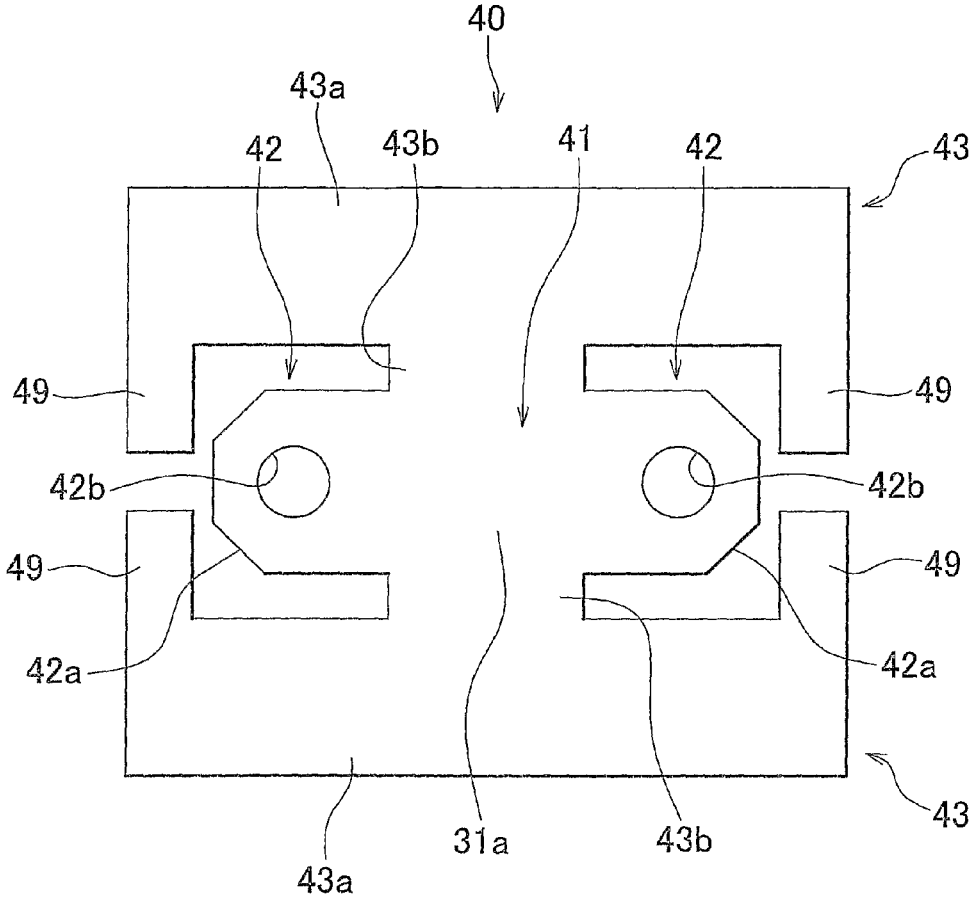
FIG. 27 is a drawing showing a plate-shaped material as claimed in a sixth embodiment of the invention.

As shown in FIG. 27, the plate-shaped material 40 of the sixth embodiment has portions that form the extending portions 39 in the form of end protruding pieces 49. The end protruding pieces 49 are provided on the strip-like portions 43*a* of the third portions 43. The end protruding pieces 49 are formed as roughly rectangular portions protruding toward the opposing third portions 43 at both ends in the lengthwise direction (horizontal direction in FIG. 27) on the strip-like portions 43*a* (in FIG. 27, the end protruding pieces 49 provided on the upper strip-like portion 43*a* are on the lower side of the upper strip-like portion 43*a*, while the end protruding pieces 49 provided on the lower strip-like portion 43*a* are on the upper side of the lower strip-like portion 43*a*). The extending portions 39 are formed by curving strip-like portions 43*a* including the end protruding pieces 49 in this manner in the above-mentioned second forming step.

Furthermore, in the sixth embodiment, although the end protruding pieces 49 that form the extending portions 39 in the body 30 are provided on both sides in the lengthwise direction of the strip-like portions 43*a* for each of the pair of strip-like portions 43*a*, the end protruding pieces 49 are not limited thereto. In other words, the extending portions 39 may be provided only on one side in the circumferential direction in each curved portion 33*a* or may be provided only on one of the pair of curved portions 33*a*. In this case, in the plate-shaped material 40, the end protruding pieces 49 are provided only on one side in the lengthwise direction in the strip-like portions 43*a* or are provided only on one of the pair of strip-like portions 43*a*.

According to the roller lifter 20 of the sixth embodiment, the guide surfaces 34 can be lengthened in the vertical direction without increasing the length in the vertical direction of the body 30. As a result, since the guiding length of the roller lifter 20 by the guide surfaces 34 (contact surfaces of the guide surfaces 34 with the inner peripheral surface 18*a* of the lifter guide 18) is increased, the orientation of the roller lifter 20 that reciprocates within the lifter guide 18 is inhibited from inclining (so-called cocking) and becomes stable within the range of the clearance.

Namely, as shown in FIG. 26, in the roller lifter 20, the effect of inhibiting cocking of the roller lifter 20 within the lifter guide 18 as described above increases the greater the length (guiding length) in the vertical direction of the guide surfaces 34 with respect to the length of a diameter D of the body 30. With respect to this point, in the case the body 30 has the extending portions 39 in the manner of the roller lifter 20 of the sixth embodiment, the value of the ratio of the guiding length L1 to the diameter D (L1/D) is roughly double the value in the case the body 30 does not have the extending portions 39 (value of L2/D). In other words, stability of the orientation of the roller lifter 20 within the lifter guide 18 is improved by providing the extending portions 39 in the body 30.

Figure 28:
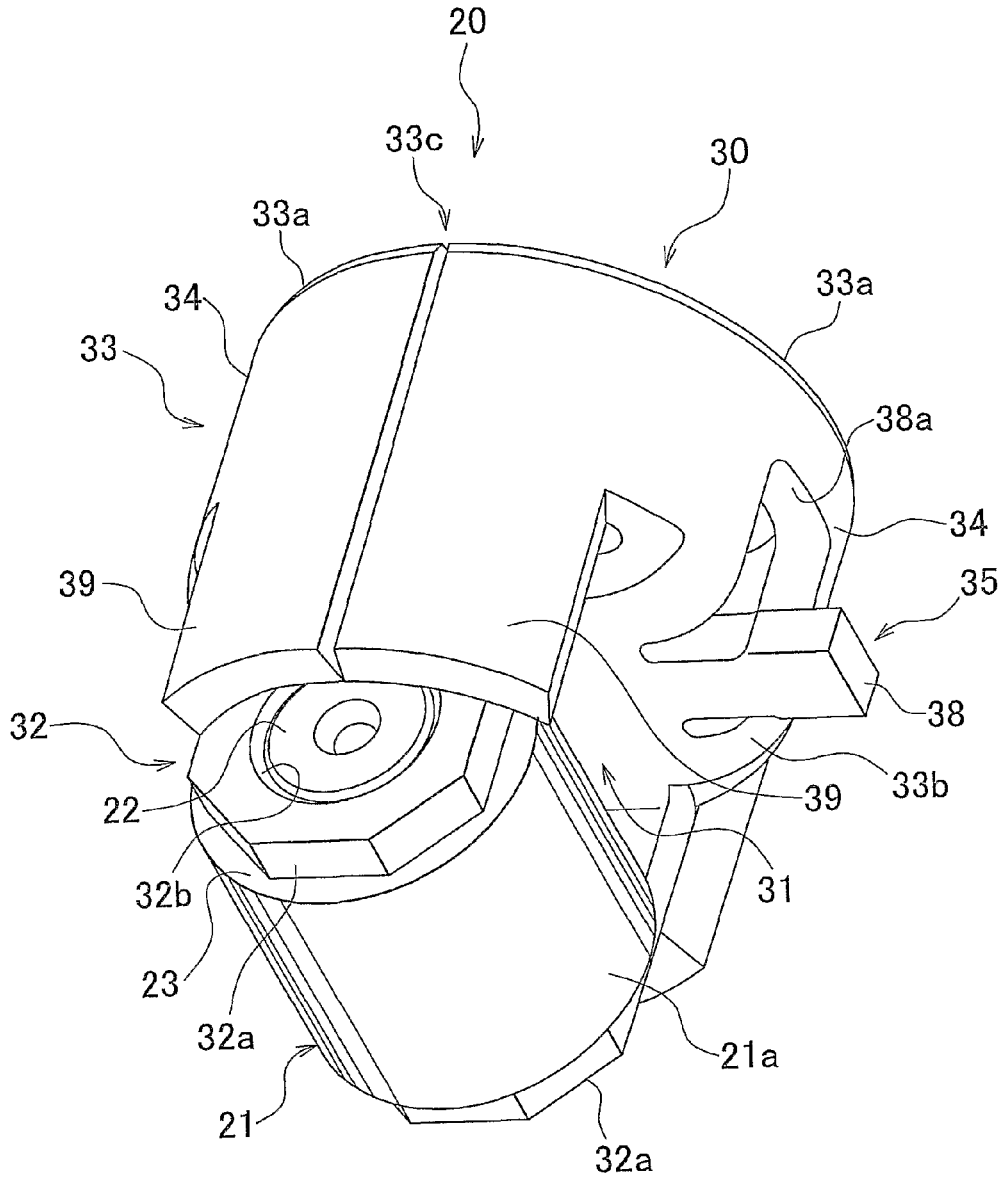
FIG. 28 is a perspective view of a roller lifter as claimed in a seventh embodiment of the invention.

Each portion provided in the roller lifter 20 of each embodiment as explained thus far can be suitably combined in a single roller lifter 20. The following provides an example of such a combination in the form of a seventh embodiment of the roller lifter 20. As shown in FIG. 28, the rotation stopper 35, the contacting portions 33*c* and the extending portions 39 are provided in the roller lifter 20 of the seventh embodiment.

Namely, the roller lifter 20 of the seventh embodiment has the rotation stopper 35 in the form of an extending piece 38 in the same manner as the fourth embodiment. In addition, the roller lifter 20 of the seventh embodiment has the extending portions 39 explained in the sixth embodiment. Moreover, in the roller lifter 20 of the seventh embodiment, contacting portions 33*c* are provided in a state in which ends of the pair of opposing curved portions 33*a* are in contact in the same manner as in the fifth embodiment. Here, in the roller lifter 20 of the seventh embodiment, the contacting portions 33*c* are provided as a result of contact between those portions including the extending portions 39 as the ends of the curved portions 33*a*.

Thus, although not shown in the drawings, the plate-shaped material 40 of the seventh embodiment has a portion corresponding to the stamped out piece 48 (see FIG. 20), a portion corresponding to the extending portion 43*c* (see FIG. 24), and portions corresponding to the end protruding pieces 49 (see FIG. 27). The rotation stopper 35, the contacting portions 33*c* and the extending portions 39 are formed in the body 30 by forming each of these portions of the plate-shaped material 40 by a forming step as previously described. In this manner, effects resulting from providing each of these portions can be obtained with the roller lifter 20 of the seventh embodiment having the rotation stopper 35, the contacting portions 33*c* and the extending portions 39.

Although each of the above-mentioned embodiments of the invention has been explained by using the high-pressure fuel pump 1 (see FIG. 1) composing a fuel supply system of an automobile engine as an example of a liquid pump provided with the roller lifter 20, the invention is not limited thereto, but rather the liquid pump may also be another type of liquid pump. In other words, in addition to a high-pressure fuel pump for an automobile engine, the roller lifter as claimed in the invention can also be applied to various liquid pumps provided with a plunger that pumps liquid by reciprocating, a cam that causes the plunger to reciprocate by rotating, and an elastic member for urging the plunger in the direction of reciprocating motion that faces the plunger.

The invention claimed is:

1. A roller lifter comprising:

a roller that is rotatably supported; and a body that supports the roller, wherein the body includes:

a base portion that is a flat plate including a first surface and a second surface;

a roller holding portion constituted by a pair of opposing plate-shaped portions that are bent towards the, first surface, the roller holding portion being configured to hold the roller between the plate-shaped portions; and a guide portion including a curved portion that is bent towards the second surface and that is curved so that the guide portion includes a guide surface that follows a cylindrical surface shape, in which a direction perpendicular to the second surface is an axial direction of the cylindrical surface shape, and at least part of the guide surface is outwardly positioned in an axial direction of the roller with respect to the pair of opposing plate-shaped portions of the roller holding portion.

2. The roller lifter according to claim 1, wherein:

the body is provided with a rotation stopper including a plate-shape, the rotation stopper is movably enclosed in a guide member having a surface to contact with the guide surface and protrudes from the body outward in a radial direction of the cylindrical surface shape, the rotation stopper being configured to prevent relative rotation of the body, with respect to the guide member by engaging with the guide member.

3. The roller lifter according to claim 2, wherein:

the rotation stopper is an end portion of the guide portion, and the end portion is bent toward the radial direction of the cylindrical surface shape.

4. The roller lifter according to claim 2, wherein:

the rotation stopper is an extending portion that extends from the base portion.

5. The roller lifter according to claim 1, wherein:

the curved portion has end portions that mutually make contact in a circumferential direction with respect to the cylindrical surface shape.

6. The roller lifter according to claim 1, wherein:

the curved portion has a gap between end portions of the curved portion in a circumferential direction with respect to the cylindrical surface shape.

7. The roller lifter according to claim 1, wherein:

the guide portion includes an extending portion that is elongated from the curved portion in a direction toward the first surface, and the guide surface is constituted by the curved portion and the extending portion.

8. The roller lifter according to claim 7, wherein:

a length of the extending portion is substantially equal to a length of the curved portion in the direction perpendicular to the first surface.

9. A method of producing a roller lifter having a roller that is rotatably supported, comprising:

preparing of a flat plate having a first portion that constitutes a base portion of the flat plate, a second portion that is a pair of portions that protrude from the first portion in mutually opposite directions, and a third portion that is a portion that protrudes from the first portion in at least a direction that intersects the protruding direction of the second portion, the base portion including a first surface and a second surface;

forming a roller holding portion by bending the pair of portions of the second portion towards the first surface, so that the pair of portions opposes each other and constitutes the roller holding portion configured to hold the roller between the pair of portions; and forming a guide portion by bending the third portion towards the second surface of the base portion and curving the third portion so that the guide portion includes a guide surface that follows a cylindrical surface shape, in which a direction perpendicular to the second surface is an axial direction of the cylindrical surface shape, and at least part of the guide surface is outwardly positioned in an axial direction of the roller with respect to the pair of portions that constitutes the roller holding portion.

10. The method of producing the roller lifter according to claim 9, wherein:

the forming the guide portion includes further forming a protruding portion that protrudes outward in a radial direction of the cylindrical surface shape.

11. The method of producing the roller lifter according to claim 9, wherein:

the forming the roller holding portion and the forming the guide portion are all carried out by press forming.

12. A liquid pump having a roller lifter produced according to the method of producing a roller lifter according to claim 9, the liquid pump further comprising:

a plunger that pumps a liquid by reciprocating motion;

a cam that reciprocates the plunger by rotating; and an elastic member that urges the plunger in a direction of the reciprocating motion toward the cam, wherein the roller supports the plunger by the base portion, and contacts the cam through the roller in a state of being urged in the direction toward the cam by the elastic member.

13. A roller lifter comprising:

a roller that is rotatably supported; and a body that supports the roller, wherein the body includes:

a base portion that is a flat plate including a first surface and a second surface;

a roller holding portion constituted by a pair of opposing plate-shaped portions that are bent towards the first surface, the roller holding portion being configured to hold the roller between the plate-shaped portions; and a guide portion including a curved portion that is bent towards the second surface and that is curved so that the guide portion includes a guide surface that follows a cylindrical surface shape, in which a direction perpendicular to the second surface is an axial direction of the cylindrical surface shape, the body is provided with a rotation stopper including a plate-shape, the rotation stopper is movably enclosed in a guide member having a surface to contact with the guide surface and protrudes from the body outward in a radial direction of the cylindrical surface shape, the rotation stopper being configured to prevent relative rotation of the body with respect to the guide member by engaging with the guide member, with the axial direction of the cylindrical surface shape, the axial direction of the cylindrical surface shape is a direction of an axis of rotation, the rotation stopper is an end portion of the guide portion, and the end portion is bent toward the radial direction of the cylindrical surface shape.

14. The roller lifter according to claim 1, wherein:

the guide portion includes a pair of curved portions, and a gap is defined by end portions of the curved portions in a circumferential direction with respect to the cylindrical surface shape.

* * * * *